US006336765B1

(12) United States Patent
Watanabe

(10) Patent No.: US 6,336,765 B1
(45) Date of Patent: Jan. 8, 2002

(54) TWIST LOCK FOR CONNECTING CONTAINERS

(75) Inventor: Yoshitaka Watanabe, 9-15-413, Nishiogikita 2-chome, Suginami-ku, Tokyo 167-0042 (JP)

(73) Assignees: Kabushiki Kaisha Marifit, Hyogo; Kabushiki Kaisha Tosen Technology, Tokyo; Kabushiki Kaisha Sanwa, Hyogo; Yoshitaka Watanabe, Tokyo, all of (JP)

( * ) Notice: Subject to any disclaimer, the term of this patent is extended or adjusted under 35 U.S.C. 154(b) by 0 days.

(21) Appl. No.: 09/581,504

(22) PCT Filed: Oct. 19, 1998

(86) PCT No.: PCT/JP98/04724

§ 371 Date: Jun. 16, 2000

§ 102(e) Date: Jun. 16, 2000

(87) PCT Pub. No.: WO00/23358

PCT Pub. Date: Apr. 27, 2000

(51) Int. Cl.[7] ..... B60P 1/64; B25G 3/18; B65D 21/02

(52) U.S. Cl. ..... 403/325; 24/287; 24/589.1; 24/590.1; 403/322.1; 403/322.2; 403/322.4; 403/321; 410/52; 410/77; 410/82

(58) Field of Search ..... 403/322.4, 321, 403/322.1, 322.2, 325, 257; 24/287, 589.1, 590.1, 613; 410/52, 77, 78

(56) References Cited

U.S. PATENT DOCUMENTS

| | | | | |
|---|---|---|---|---|
| 3,691,595 A | * | 9/1972 | Backteman et al. | 24/287 |
| 3,924,544 A | * | 12/1975 | Grau et al. | 410/78 |
| 4,277,212 A | * | 7/1981 | Rosaia | 24/287 X |
| 4,564,984 A | * | 1/1986 | Takaguchi | 24/287 |
| 5,002,418 A | * | 3/1991 | McCown et al. | 24/287 X |
| 5,954,531 A | * | 9/1999 | Jennings et al. | 403/325 X |

FOREIGN PATENT DOCUMENTS

| | | | |
|---|---|---|---|
| JP | 46-11020 A1 | * | 11/1971 |
| JP | 5-121395 A1 | * | 8/1984 |
| JP | 62-592 A1 | * | 6/1987 |
| JP | 2-59189 A1 | * | 4/1990 |
| JP | 10-507984 A1 | * | 8/1998 |

* cited by examiner

*Primary Examiner*—Lynne H. Browne
*Assistant Examiner*—Ernesto Garcia
(74) *Attorney, Agent, or Firm*—Rader, Fishman & Grauer, PLLC

(57) ABSTRACT

A twist lock for connecting containers comprises a housing integrally formed with an upper fitting part and a lower fitting part each being capable of fitting into a fitting hole in a corner fitting of a container, a spindle inserted in the housing in a rotatable and vertically displaceable manner, an upper lock connected to the top end of the spindle and being engageable with the fitting hole in the corner fitting of the container, and a lower lock being in positional agreement with and fixed securly to the lower fitting part of the housing and slidably fitted with a plurality of locking members which can engage with and disengage from the fitting hole in the corner fitting of the container. In this twist lock, the spindle is urged by a spring member in such a direction that the upper lock can engage with the fitting hole in the corner fitting of the container, while each of the locking members is urged by another spring member in such a direction that it can retract into the lower lock. When the spindle locates at a lowered position, the locking members contact the spindle and project from the lower lock against the urging force of the spring means, thereby engaging with the fitting hole in the corner fitting of the container to prevent the release of the lower lock. When the spindle locates at a raised position, the locking members lose contact with the spindle and retract into the lower lock by the urging force of the spring means, thereby disengaging from the fitting hole in the corner fitting of the container to permit the release of the lower lock.

8 Claims, 20 Drawing Sheets

TWIST LOCK FOR CONNECTING CONTAINERS

TECHNICAL FIELD

The present invention relates to a twist lock, to be disposed between two containers, for connecting the containers loaded or stored on top of each other in multiple tiers in a container yard or on a containership.

BACKGROUND ART

As illustrated in FIG. 11, containers Ct are generally loaded and unloaded between a container yard Yd and a containership Sh.

By way of example, for the loading of a container Ct, a container Ct stored at the container yard Yd is first loaded on a container vehicle V such as a trailer by means of a transfer crane Tc or a straddle carrier and then carried to the apron Ap. A container Ct at the apron Ap is lifted by a spreader Sp of a container crane Cr and rested on another container Ct on the deck of a containership Sh.

As for the unloading of a container Ct from the deck of a containership Sh, a container Ct is lifted and transferred to the apron Ap by means of the spreader Sp of the container crane Cr. The container Ct is then loaded on the container vehicle V, and carried from the apron Ap to the container yard Yd.

When containers Ct are loaded or stored in multiple tiers in a container yard Yd or on a S containership Sp, an upper container Ct and a lower container Ct are connected with each other to prevent them from falling off. As the connection means, container locks are disposed, via fitting parts, between the four bottom corners of the upper container and the four top corners of the lower container.

An example of such container locks is disclosed in International Publication No. WO92/05093 as twist lock.

The twist lock 100 is described, referring to FIGS. 12 to 15.

The twist lock 100 comprises a housing 101 composed of a right housing component and a left housing component integrally joined by a bolt, a spindle 102 (FIG. 15) rotatably held in the housing 101, and an upper twist lock cone 103 and a lower twist lock cone 104 which are integrally connected to the upper end and the lower end of the spindle 102, respectively.

The housing 101 includes an upper raised part 101U and a lower raised part 101D integrally incorporated on the upper and lower portions. The upper and lower raised parts 101U, 101D are designed in a shape which matches a fitting hole Fa of a corner fitting F mounted on the container Ct (FIG. 18), and capable of fitting into a fitting hole Fa formed in a bottom corner fitting F of an upper container Ct and a fitting hole Fa formed in a top corner fitting F of a lower container Ct, respectively.

The housing 101 further includes a through-hole (not shown) which extends through the upper raised part 101U and the lower raised part 101D, and which supports the spindle 102.

The corner fitting F having the fitting hole Fa to be mounted on a container Ct is not specifically illustrated herein. For their specification, reference can be made to JIS Z1616.

The upper twist lock cone 103 and the lower twist lock cone 104 are designed to match the shape of the fitting hole Fa in the corner fitting F of the container Ct, and engageable with the fitting hole Fa. In association with the rotation of the spindle 102, the upper and lower twist lock cones 103, 104 rotate on the top surface of the upper raised part 101U and the bottom surface of the lower raised part 101D, respectively. When the upper twist lock cone 103 is detachable with respect to the fitting hole Fa in the bottom corner fitting F of the upper container Ct, the lower twist lock cone 104 is engaged with the fitting hole Fa in the top corner fitting F of the lower container Ct. On the other hand, when the lower twist lock cone 104 is detachable with respect to the fitting hole Fa in the top corner fitting F of the lower container Ct, the upper twist lock cone 103 integrally connected to the spindle 102 is engageable with the fitting hole Fa in the bottom corner fitting F of the upper container Ct, in which case a top view of the twist lock shows the spindle 103 crossing over the fitting hole Fa in the form of the letter X.

The lower twist lock cone 104 is shaped such that it is imparted with a rotating force when pressed against the fitting hole Fa in the corner fitting F, provided that the lower cone 104 is in an engaging position with respect to the fitting hole Fa. To be more specific, the lower twist lock cone 104 is engageable with the fitting hole Fa in the corner fitting F, when the spindle 102 stays at the first position A to be described below. Under this condition, by pressing the lower twist lock cone 104 against the edge of the fitting hole Fa in the corner fitting F, a pressurising force is imposed on the corner fitting F through the lower twist lock cone 104, whereas the lower twist lock cone 104 receives a reactive force in return. Owing to the reactive force acting on the lower twist lock cone 104, a properly shaped lower twist lock cone 104 is forced to rotate around the rotation axis of the spindle 102.

As shown in FIG. 15, a cavity 101X is formed inside the housing 101, and provided with a first stop element 101*a* and a second stop element 101*b* which can be contacted by a stop arm 1021 securely integrated with the spindle 102. In this structure, the spindle 102 is capable of rotating between the first position A and the third position C where the stop arm 1021 contacts the first stop element 101*a* and the second stop element 101*b* in the cavity 101X, respectively.

Normally, the spindle 102 is urged by a torsion spring 105, whereby the stop arm 1021 stays in contact with the first stop element 101*a* in the cavity 101X. Further, a wire 106 is disposed along a groove 1022 formed in the circumference of the spindle 102. One end of the wire 106 is looped around the stop arm 1021, while the other end is drawn out through a nozzle 107 and fixed to a handle 108. Of the nozzle 107, the right and left edge portions are slidably fitted in a transverse slot 101Y, and the upper and lower portions are provided with slots 107*a*, 107*c*, respectively. Further, a stop element 1061 is provided in the vicinity of the handle-side end of the wire 106. The stop element 1061 is capable of checking selectively at the slot 107*a* or 107*c*.

The nozzle 107 is displaceable along the transverse slot 101Y in which the right and left edge portions thereof are fitted. The nozzle 107 is usually urged into contact with one end of the transverse slot 101Y by means of a spring 109 arranges within the housing 101.

With the use of the above twist lock 100, two vertically loaded containers Ct are joined in the following manner. First, a container Ct in a container yard Yd is loaded on a container vehicle V using a transfer crane Tc and carried to an apron Ap. Then, in the apron Ap, the container Ct is lifted by a spreader Sp of a container crane Cr and suspended approximately one meter above the ground, where the upper twist lock cone 103 of the twist lock 100 is mounted to every bottom corner fitting F of the container Ct (FIG. 16). Specifically, the handle 108 is pulled by hand in order to check the stop element 1061 of the wire 106 at the slot 107*a* of the nozzle 107. At this first checking position, the spindle 102 is rotated to the third position C where the stop arm 1021 contacts the second stop element 101*b* in the cavity 101X, while the upper twist lock cone 103 comes in agreement with the upper raised part 101U of the housing 101, as seen from above. Thereby, the upper twist lock cone 103 can be inserted together with the upper raised part 101U into the fitting hole Fa in the bottom corner fitting F of the upper container Ct. Once the upper twist lock cone 103 is inserted into the fitting hole Fa, the handle 108 is pulled by hand again so as to release the stop element 1061 of the wire 106 from the slot 107*a* of the nozzle 107. On the release of the stop element 1061, the torsion spring 105 urges the spindle 102 back to the first position A where the stop arm 1021 contacts the first stop element 101*a* in the cavity 101X. At the first position A, the upper and lower twist lock cones 103, 104 are both engaged with the fitting holes Fa in the corner fittings F, as mentioned above, whereby the twist lock 100 does not fall off or come out from the corner fitting F of the container Ct (FIG. 17).

After the twist locks 100 are mounted on the bottom corner fittings F, the container Ct is lifted by a container crane Cr and transferred onto another container Ct on the deck of a containership Sh (FIG. 18). While the container Ct is being rested, the lower twist lock cone 104 of each twist lock 100 is forced to rotate along the edge of the fitting hole Fa in a corresponding top corner fitting F of the lower container Ct, against the urging force deriving from the torsion spring 105. When the lower twist lock cone 104 is rotated into agreement with the lower raised part 101D of the housing 101 as seen from above, the lower twist lock cone 104 and the lower raised part 101D enter the fitting hole Fa in the top corner fitting F of the lower container Ct. Having entered the top corner fitting F, the lower twist lock cone 104 returns to the engaging position due to the urging force of the torsion spring 105 and engages with the fitting hole Fa. Upon the engagement, the upper and lower containers Ct are joined by the twist locks 100, wherein the upper and lower twist lock cones 103, 104 are engaged with the bottom corner fittings F of the upper container Ct and the top corner fittings F of the lower container Ct, respectively (FIG. 19).

Now, the container Ct loaded on the deck of the containership Sh is unloaded in the following process. With the lower twist lock cone 104 locating at the engaging position, the handle 108 is pulled down or pushed down on the deck so as to check the stop element 1061 at the slot 107*c*. At this second checking position, the spindle 102 and the stop arm 1021 locate at the second position B between the first stop element 101*a* and the second stop element 101*b* in the cavity 101X of the housing 101. At the second position B, the lower twist lock cone 104 positionally corresponds to the lower raised part 101D of the housing 101 as seen from above, and can be thus removed from the fitting hole Fa in the top corner fitting F of the lower container Ct (FIG. 20).

Following the release of the lower twist lock cone 104, the container Ct is transferred by the spreader Sp of the container crane Cr, and then suspended approximately one meter above the ground at the apron Ap, where the upper twist lock cone 103 is removed from each bottom corner fitting F of the container Ct. Specifically, the handle 108 is pulled by hand to check the stop element 1061 of the wire 106 at the slot 107*a* of the nozzle 107. At this first checking position, the spindle 102 is rotated to the third rotation position C where the stop arm 1021 contacts the second stop element 101*b* in the cavity 101X, while the upper twist lock cone 103 comes in positional agreement with the upper raised part 101U of the housing 101 as seen from above. Therefore, the twist lock 100 can be removed from the fitting hole Fa in the bottom corner fitting F of the container Ct (FIG. 21). Thereafter, the container Ct at the apron Ap is loaded onto the container vehicle V by the container crane Cr and transported to the container yard Yd.

DISCLOSURE OF THE INVENTION

The above-mentioned conventional twist lock has facilitated the loading and joining of containers. In the loading of containers, the twist lock is attached to a bottom corner fitting of a container to be loaded. By resting this container on another container, the lower twist lock cone enters a top corner fitting of the lower container, with rotating along the edge of the fitting hole in the corner fitting. Upon the entry, the lower cone automatically returns to the position engaging with the corner fitting as urged by a torsion spring. Eventually, the upper and lower containers are joined together. On the other hand, in the unloading of the containers, the spindle (i.e. the lower twist lock cone) needs to be rotated from the engaging position to the releasable position against the urging force of the torsion spring, in which case the rotation should be effected by manual operation of the handle. In order to check the stop element of the wire at the slot of the nozzle, a dockworker has to pull down or push down the handle with the use of a long actuator pole, on the top of the multiple tiers of containers, or on the deck (in a containership) or the ground (in a container yard) as shown in FIG. 20. Such an unlocking process not only requires a long working time but also imposes a substantial physical burden to dockworkers. It is obviously difficult and exhausting to operate the handle with the tip of a long and heavy actuator pole. In addition, the twist lock of prior art is undesirable in the safety aspect, because operation on the top-tier containers inevitably involves the risks of falling off therefrom and other accidents.

In order to solve these problems, the present invention intends to provide a twist lock for connecting containers which enables the automatic connection and the automatic disconnection between an upper container and a lower container, without any high-place operations or the like.

According to the first embodiment of the present invention, a twist lock for connecting containers comprises a housing integrally including an upper fitting part and a lower fitting part each being capable of fitting into a fitting hole in a corner fitting of a container and being formed with a through-hole which extends through the upper and lower fitting parts, a spindle inserted in the through-hole in a rotatable and vertically displaceable manner, an upper lock connected to the top end of the spindle and being engageable with the fitting hole in the corner fitting of the container, and a lower lock being in positional agreement with and fixed securely to the lower fitting part of the housing and slidably fitted with a plurality of locking members which can engage with and disengage from the fitting hole in the corner fitting of the container. In this twist lock, the spindle is urged by a spring member in such a direction that the upper lock can engage with the fitting hole in the corner fitting of the container, while each of the locking members is urged by another spring member in such a direction that each locking member can retract into the lower lock. When the spindle locates at a lowered position, the locking members contact the spindle and project from the lower lock against the urging force of the spring means, thereby engaging with the fitting hole in the corner fitting of the container to prevent the release of the lower lock. When the spindle locates at a raised position, the locking members lose contact with the spindle and retract into the lower lock by the urging force of the spring means, thereby disengaging from the fitting hole in the corner fitting of the container to permit the release of the lower lock.

For the loading of a container, the twist lock of the first embodiment is attached to a container by mounting the upper lock into a fitting hole in a bottom corner fitting of the container. While the housing descends relative to the spindle due to its own weight, the locking members lose contact with the spindle and retract into the lower lock. As a result, the lower lock can be introduced into a fitting hole in a top corner fitting of another container. When the container is transferred onto the lower container, the spindle descends relative to the housing. As the spindle contacts and pushes out the locking members, they are engaged with the fitting hole in the top corner fitting of the lower container to connect the upper and lower containers.

Unloading of the container is performed simply by lifting the container. Thereby, the spindle is raised, relative to the housing, by the upper lock engaging with the fitting hole in the bottom corner fitting of the upper container. The locking members thus lose contact with the spindle and retract into the lower lock. Consequently, the locking members are disengaged from the fitting hole in the top corner fitting of the lower container, from which the lower lock can come out.

As described above, when a container mounted with the twist lock at the fitting hole in every bottom corner fitting is rested onto another container, the lower lock is fitted into the fitting hole in the top corner fitting of the lower container, and the locking members are engaged therewith. Likewise, simply by lifting the container, the locking members are disengaged from the fitting hole in the top corner fitting of the lower container. Thus, the twist lock of the present invention enables not only automatic connection between the upper and lower containers in loading, but also automatic disconnection between the twist lock and the lower container in unloading. This advantage eases the workload and provides safe working environments, as the dockworkers no longer have to work on the top of multiple-tier containers or to operate a working tool.

In a preferable structure of the above twist lock, the spindle is linked with a stop handle through a linking member, and the housing includes a stop for checking the stop handle.

According to this structure, the stop handle connected to the linking member is manually pulled and checked at the stop in the housing. Thereby, the spindle is rotated against the urging force of the spring means, allowing the upper lock fixed to the spindle to rotate to and remain at a position where the upper lock can be freely inserted into or removed from the fitting hole in the corner fitting of the container. Therefore, even if the twist lock may be broken, at least the upper container can be disconnected from the twist lock as an emergency measure.

In another preferable structure, a fitting groove is formed in the outer circumferential surface of the spindle, and at least one connecting bore is provided in the right and left components of the housing, respectively. Each connecting bore is formed in a predetermined length in the direction extending from a radius of the through-hole, and has an open end at a position facing the fitting groove in the spindle at the lowered position. At least one ball is rotatably accommodated in each connecting bore.

According to this structure, when the vertically connected containers are inclined, the ball rolls along one of the connecting bores corresponding to the inclined direction of the housing. Thus, the ball is to fit into the fitting groove in the spindle at the lowered position. Consequently, the spindle can bear the lift-up force resulting from the jump of the containers and transmitted via the upper lock. The connection between the upper and lower containers is thus maintained.

In still another preferable structure, a fitting groove is formed in the inner circumferential surface of the housing, and at least one connecting bore is provided in the right and left portions of the spindle, respectively. Each connecting bore extends in a radius direction of the through-hole and communicates with each other at the centre. Further, each connecting bore has an open end at a position facing the fitting groove in the housing, provided that the spindle locates at the lowered position and the upper lock is engaged with the fitting hole in the corner fitting of the container. At least one ball is rotatably accommodated in the connecting bores.

According to this structure, when the vertically connected containers are inclined, the ball rolls along one of the connecting bores corresponding to the inclined direction of the spindle at the lowered position. Thus, the ball is to fit into the fitting groove in the housing. Consequently, the spindle can bear the lift-up force resulting from the jump of the containers and transmitted via the upper lock. The connection between the upper and lower containers is thus maintained.

Preferably, each connecting bore in the above structures is inclined, by a predetermined downward gradient, from the open end facing the fitting groove formed in the spindle or the housing down to the direction in which the connecting bore extends.

Due to the gradient, when the containers stay level, each ball rolls down to the bottom end of the connecting bore and does not interfere with the fitting groove in the spindle. Therefore, this arrangement permits the upward movement of the spindle, except when the inclination of the containers exceeds the gradient of the connecting bore, while effectively preventing the accidental locking of the spindle in unloading the containers.

In a further preferable structure, a fitting groove is formed in the outer circumferential surface of the spindle, and at least one connecting bore is provided in the right and left components of the housing, respectively. Each connecting bore is formed in a predetermined length in the direction extending from a radius of the through-hole, and has an open end at a position facing the fitting groove in the spindle at the lowered position. In addition, each connecting bore accommodates a plurality of balls in a rotatable manner. The housing further includes a pair of fitting bores vertically formed on the right and left sides of the upper fitting part along a concentric circle of the through-hole, with the bottom end of each fitting bore communicating with the connecting bore. A guide is inserted in each fitting bore in a vertically slidable manner and urged by a spring means to project slowly from the top surface of the housing. Accordingly, an inner ball is allowed to fit in the fitting groove in the spindle when the guide locates at a lowered position, and allowed to roll out of the fitting groove when the guide locates at a raised position.

According to this structure, when the bottom corner fitting of the upper container is rested on the twist lock, the guides are pressed down against the urging force of the spring means. In connection with the descent of the guides, the inner balls are allowed to fit in the fitting groove in the spindle to block the upward movement of the spindle. On the other hand, when the upper container is lifted up, the guides project from the top surface of the housing by the urging force of the spring means. In connection with the rise of the guides, the inner balls roll out of the fitting groove in the spindle to permit the upward movement of the spindle. Even if the vertically connected containers are shaken violently due to high waves in the sea or the like, the rising rate of the guides is not affected by the sudden jump of the containers, so that the balls remain fitted in the fitting groove in the spindle for a certain period of time. As a result, even when the spindle is subjected to the lift-up force transmitted via the upper lock, this twist lock keeps the connection between the upper and lower containers, with preventing the upward movement of the spindle.

Preferably, the connecting bore in the above structure is inclined, by a predetermined downward gradient, from the open end facing the fitting groove in the spindle down to the other end communicating with the fitting bore.

Due to the gradient, when the containers stay level, each ball rolls down to the bottom end of the connecting bore and does not interfere with the fitting groove in the spindle. This arrangement permits the upward movement of the spindle, except when the inclination of the containers exceeds the gradient of the connecting bore, while effectively preventing the accidental locking of the spindle in unloading the containers.

BEST MODE FOR CARRYING OUT THE INVENTION

Referring to the attached drawings, the embodiments of the present invention are hereinafter disclosed.

Figure 1:
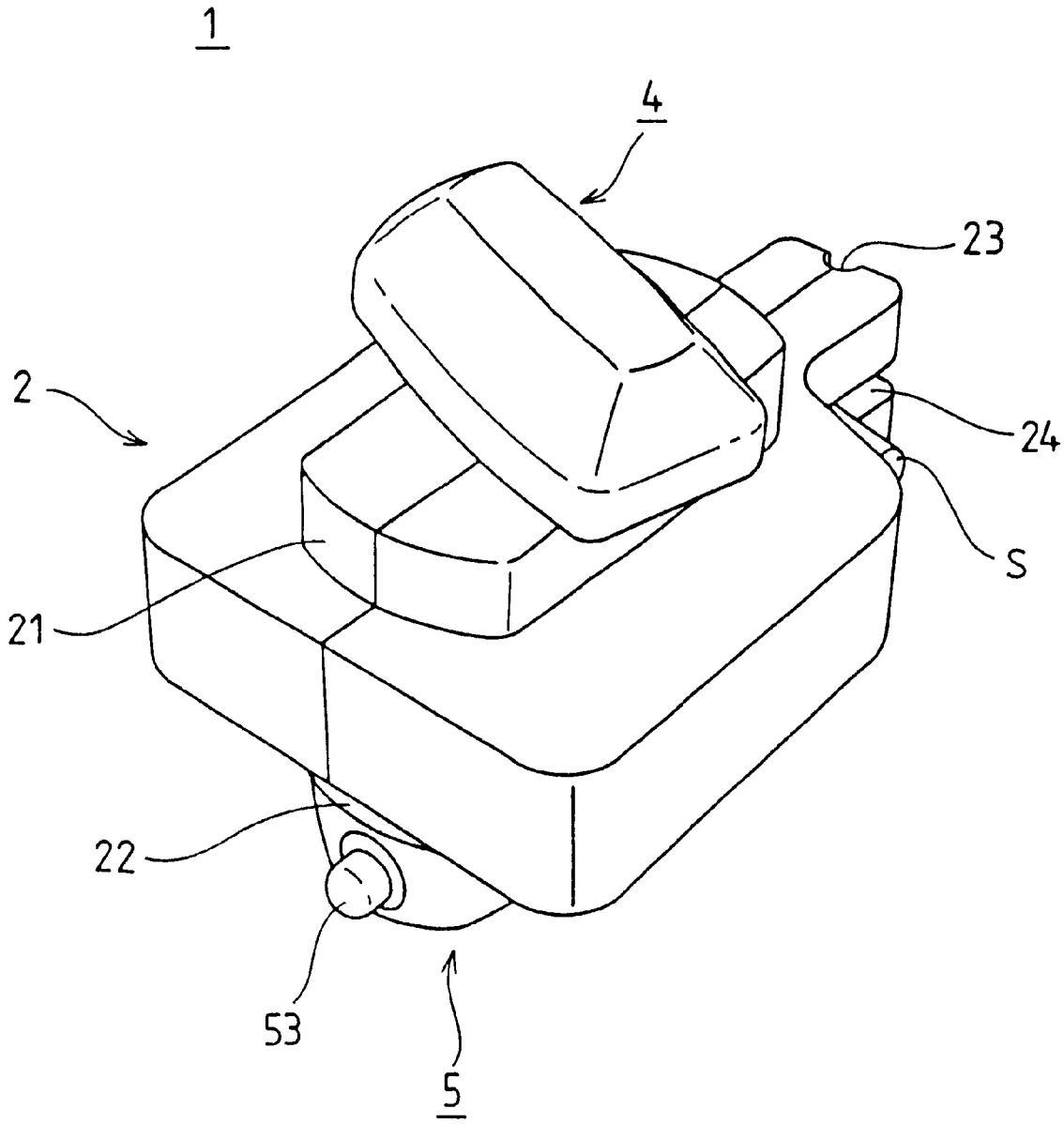
FIG. 1 is an entire perspective view of a twist lock according to the first embodiment of the present invention.
Figure 2:
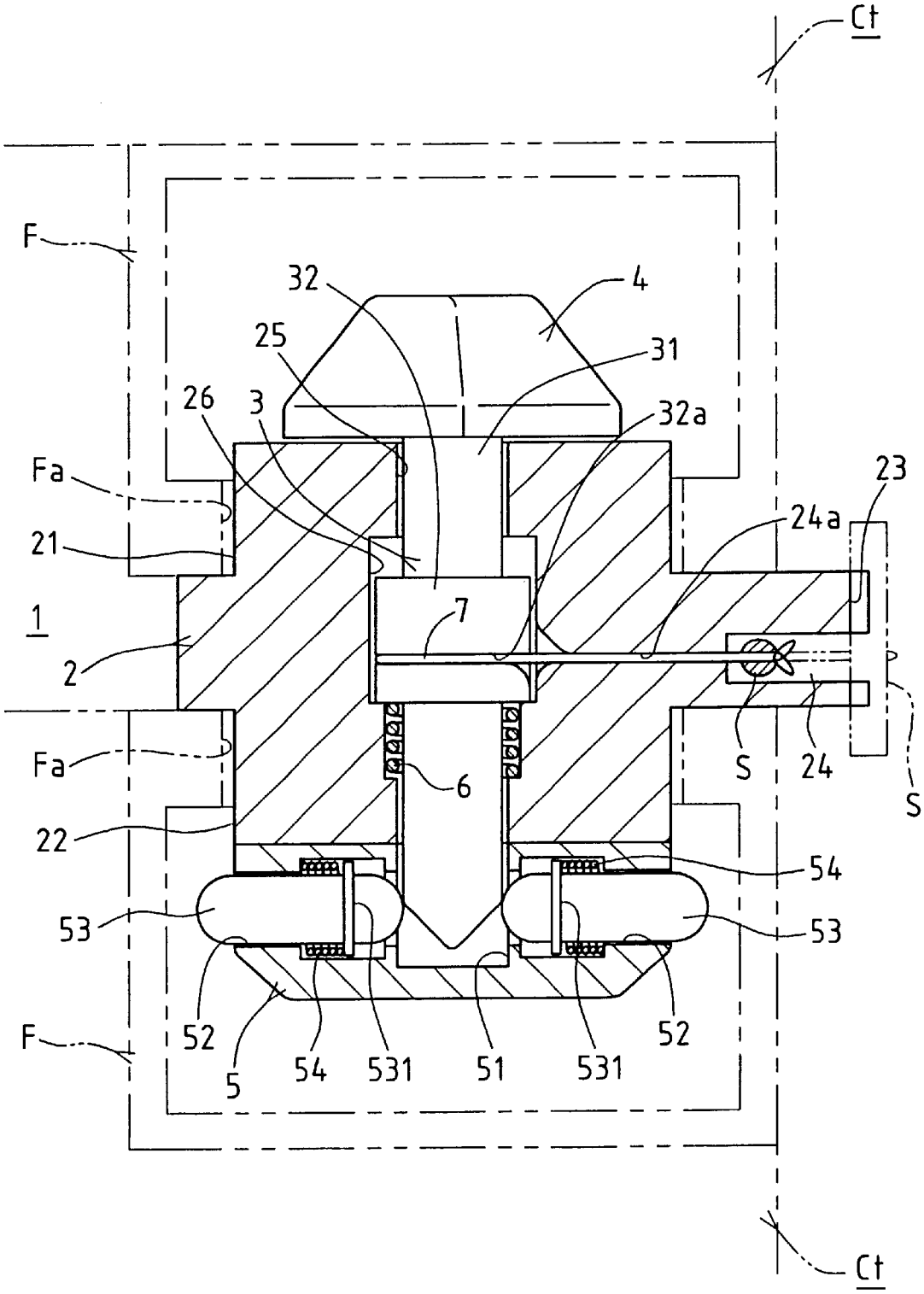
FIG. 2 is a cross-sectional view of the twist lock of FIG. 1 in the interconnecting state with containers.
Figure 3:
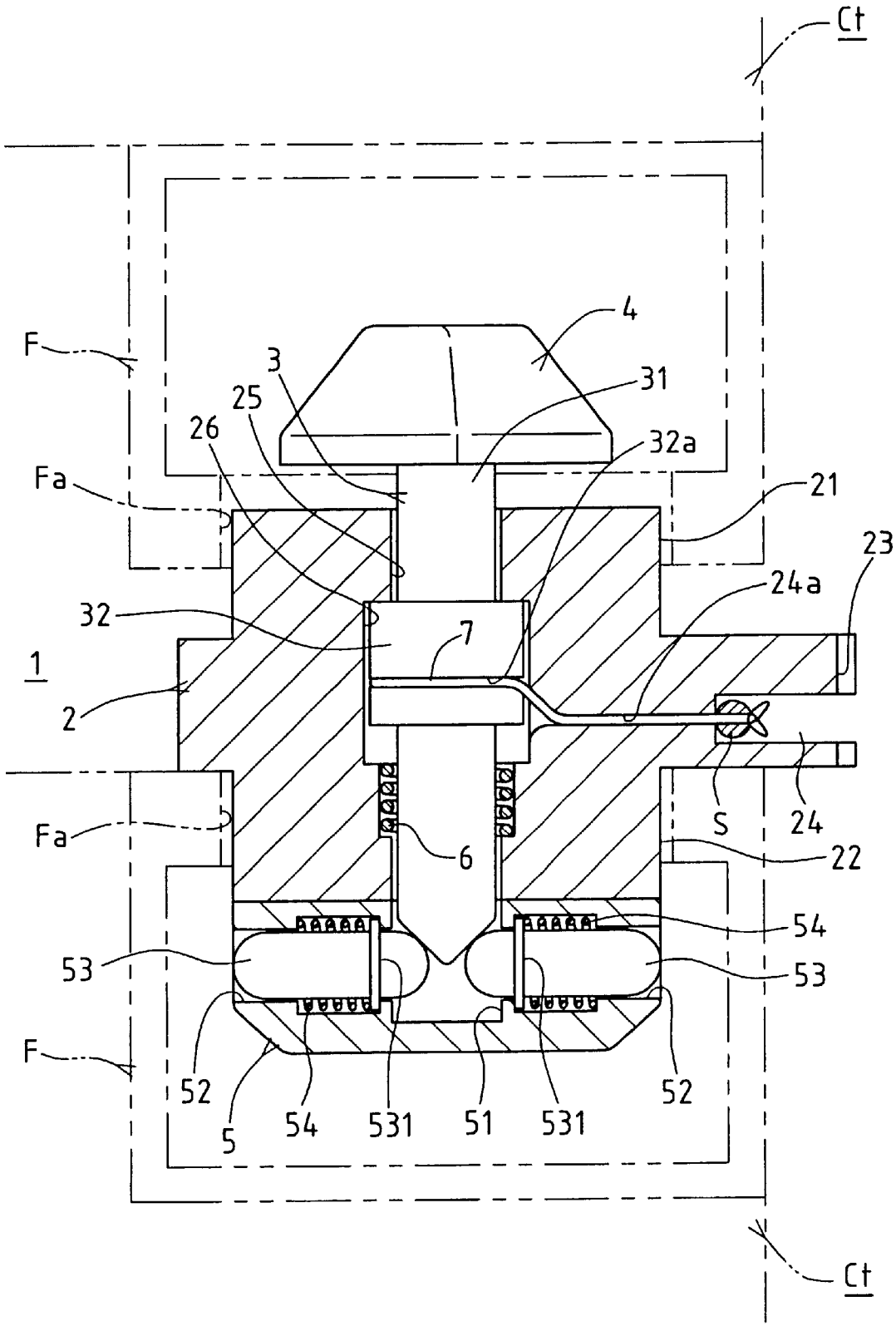
FIG. 3 is a cross-sectional view of the twist lock of FIG. 1 in the removable state with containers.

FIGS. 1 to 3 illustrate a twist lock according to the first embodiment of the present invention.

The twist lock 1 for connecting containers comprises a housing 2 composed of right and left housing components integrally joined by a bolt, a spindle 3 rotatably held in the housing 2 (FIGS. 2 and 3), an upper lock 4 integrally joined at the top end of the spindle 3, and a lower lock 5 securely fixed to the housing 2.

The housing 2 includes an upper fitting part 21 and a lower fitting part 22 integrally formed on the upper and lower portions thereof. The upper and lower fitting parts 21, 22 are shaped in agreement with the shape of a fitting hole Fa of a corner fitting F of a container Ct, and are capable of fitting into a fitting hole Fa in a bottom corner fitting F of an upper container Ct and a fitting hole Fa in a top corner fitting of a lower container Ct, respectively. At one end of the housing 2, there are formed a stop 23 for checking a stop handle S to be mentioned below, and a storage space 24 for accommodating the stop handle S.

Further, the housing 2 includes a through-hole 25 which extends through the upper and lower fitting parts 21, 22, and a cavity 26 which has a fixed height and a larger diameter than the through-hole 25. The spindle 3 is rotatably inserted in the through-hole 25 and vertically displaceable within the height of the cavity 26. The spindle 3 comprises a small-diameter spindle part 31 corresponding to the diameter of the through-hole 25, and a large-diameter spindle part 32 corresponding to the diameter of the cavity 26 and located in the near-middle portion of the small-diameter spindle part 31, wherein the large-diameter spindle part 32 is smaller in height than the cavity 26 in the housing 2. According to this structure, the spindle 3 normally stays at the lowered position due to its own weight, where the bottom surface of the large-diameter spindle part 32 rests on the bottom step defined by the through-hole 25 and the cavity 26. The total height of the spindle 3 is such that, at the lowered position, there remains a slight clearance between the upper lock 4 and the upper fitting part 21 of the housing 2 for allowing the rotation of the upper lock 4, and also that the bottom end of the spindle 3 should enter a guide hole 51 of the lower lock 5 to be described below. In addition, the upward movement of the spindle 3 is limited to the raised position, where the top surface of the large-diameter spindle part 32 contacts the top step defined by the through-hole 25 and the cavity 26.

The ascent/descent stroke of the spindle 3 is set smaller than the height of the upper fitting part 21 of the housing 2. Thereupon, the upper fitting part 21 does not drop off from the fitting hole Fa in the corner fitting F of the container Ct, when the housing 2 hangs from the corner fitting F and descends relative to the spindle 3, with the upper lock 4 being engaged with the fitting hole Fa. Thus, the position of the twist lock 1 is maintained (FIG. 3).

In connection with the spindle 3, although not shown in detail, an outwardly projecting arm is formed on the large-diameter spindle part 32 of the spindle 3, and a contact member for stopping the arm is formed in the cavity 26 in the housing 2. With the arm being in contact with the contact member, the spindle 3 cannot rotate any further. Besides, a spring means such as a torsion spring 6 is disposed around the lower part of the spindle 3, with one end of the spring 6 being linked to the spindle 3 and the other end being linked to the housing 2. The torsion spring 6 usually urges the spindle 3 such that the arm (not shown) contacts the contact member (not shown) formed in the cavity 26 of the housing 2. In this state, the position of the upper lock 4 is in engagement with the fitting hole Fa in the bottom corner fitting of the container Ct, as shown in FIG. 1.

Incidentally, one end of the torsion spring 6 is fitted into a hole (not shown) vertically formed in the large-diameter spindle part 32 of the spindle 3. Therefore, when the spindle 3 moves upwardly within the height of the cavity 26 in the housing 2, the torsion spring 6 does not come off from the spindle 3 and keeps the linkage therewith.

As for the spindle 3 which is supported in the through-hole 25 in the housing 2, the bottom end thereof is shaped approximately in the form of a cone so as to be in smooth contact with the base ends of locking members 53 disposed in the lower lock 5 to be described below. The spindle 3 further includes a groove 32*a* formed around the circumference of the large-diameter spindle part 32 for guiding a linking member such as a wire 7. One end of the wire 7 is secured to the spindle 3, while the other end is drawn out through a wire-drawing passage 24*a* formed in the housing 2 and secured to a stop handle S in the storage space 24. The stop handle S is usually accommodated in the storage space 24 in the housing 2 in such a manner that the wire 7 has some sag. Therefore, when the stop handle S connected with the wire 7 is pulled by hand, the spindle 3 (i.e. the upper lock 4) rotates against the urging force of the torsion spring 6. The stop handle S is then checked at the stop 23 of the housing 2, as shown in FIG. 2 by an imaginary line. In this checking state, the position of the upper lock 4 should agree to that of the upper fitting part 21 of the housing 2 as seen from above. Such positional relationship is achieved by judiciously designing the wire length and the positions to secure the wire 7.

When the spindle 3 yields to its own weight and lies at the lowered position on the bottom step defined by the through-hole 25 and the cavity 26 in the housing 2, the groove 32*a* in the spindle 3 is in straight communication with the wire-drawing passage 24*a* in the housing 2, as seen from the side (FIG. 2). Further, the inner end of the wire-drawing passage 24*a* opens to the cavity 26 in the form of a bell, while the groove 32*a* is gradually widened downwards at a position facing the wire-drawing passage 24*a*. These configurations are effective when the spindle 3 is upwardly displaced to the raised position, while the upper lock 4 is urged by the torsion spring 6 to the position engageable with the fitting hole Fa in the bottom corner fitting F of the container Ct. As a result, the wire 7 runs flexibly between the groove 32*a* and the wire-drawing passage 24*a,* irrespective of the height difference resulting from the upward movement of the spindle 3 (FIG. 3). The stretch of the wire 7 is compensated by the sag thereof drawn out in the storage space 24.

The lower lock 5 is formed in a shape matching to the fitting hole Fa in the corner fitting F of the container Ct. As seen from above, the lower lock 5 is positioned in agreement with the lower fitting part 22 of the housing 2 and securely fixed on the bottom surface thereof. The lower lock 5 includes a guide hole 51 having a circular cross-section and vertically communicating with the through-hole 25 in the housing 2, and a pair of passages 52 extending through the lower lock 5 in the forward/backward direction (the right/left direction in FIG. 2), with one end of each passage 52 opening to the guide hole 51. Each of the passages 52 is slidably fitted with a locking member 53 having a chamfered base end and provided with a flange 531 in the vicinity of the base end. A spring means (e.g. a spring 54) is disposed between the flange 531 of the locking member 53 and the step portion on the extreme end side defined by the small-diameter part and the large-diameter part of the passage 52. Due to the urging force of the spring 54, each locking member 53 is urged such that its base end can project into the guide hole 51.

To be specific, when the spindle 3 rests at the lowered position on the bottom step defined by the through-hole 25 and the cavity 26 in the housing 2, the bottom end of the spindle 3 is inserted into the guide hole 51 in the lower lock 5, with the outer circumferential surface thereof being in contact with the base ends of the locking members 53. As a result, the locking members 53 are pushed outwardly against the urging force of the springs 54, and the extreme ends thereof project from the surface of the lower lock 5 (FIG. 2).

On the other hand, when the spindle 3 is pulled up to the raised position and contacts the top step defined by the through-hole 25 and the cavity 26 in the housing 2, the base ends of the locking members 53 no longer contact the outer circumferential surface of the spindle 3. As a result, the locking members 53, urged by the springs 54, retract the extreme ends into the lower lock 5 (FIG. 3). In the course of projection, the flanges 531 of the locking members 53 come in contact with the step portions on the base end side defined by the small-diameter parts and the large-diameter parts of the passages 52, whereby the locking members 53 cannot project in the direction of the guide hole 51 any further (FIG. 3).

It is worth noting that the bottom end of the spindle 3 is shaped approximately in the form of a cone, and that the base ends of the locking members 53 are chamfered. This combination allows smooth displacement of the locking members 53 in association with the vertical movement of the spindle 3.

Next, description is made of the operation of the first embodiment of the twist lock 1.

FIG. 1 shows the initial state of the twist lock 1, wherein the upper lock 4 is urged by the torsion spring 6 to be in engagement with the fitting hole Fa in the corner fitting F of the container Ct. In order to mount the twist lock 1 to the fitting hole Fa in the corner fitting F, the upper lock 4 is twisted against the urging force of the torsion spring 6 to the position in agreement with the upper fitting part 21 of the housing 2 as seen from above, and, thereafter, the upper lock 4 is inserted together with the upper fitting part 21 into the fitting hole Fa in the bottom corner fitting F of the container Ct.

Once the upper lock 4 enters the fitting hole Fa in the bottom corner fitting F, the spindle 3 is urged back to the original position by the torsion spring 6, thus bringing the upper lock 4 into engagement with the fitting hole Fa in the bottom corner fitting F. With the upper lock 4 engaging with the fitting hole Fa, the housing 2 descends relative to the upper lock 4 (i.e. the spindle 3). Thus, the twist lock 1 hangs down by itself even if it is no longer supported by hand. From another point of view, the spindle 3 rises relative to the housing 2, whereby the base ends of the locking members 53 are relieved from the contact with the outer circumferential surface of the spindle 3 which stops the projection of the locking members 53. Consequently, the locking members 53 project into the guide hole 51 by the urging force of the springs 54, whereas the extreme ends thereof retract into the passages 52 in the lower lock 5 (FIG. 3). In the meantime, the projection of the locking members 53 is terminated when the flanges 531 contact the step portions on the base end side defined by the large-diameter parts and the small-diameter parts of the passages 52. After the twist lock 1 is attached to the fitting hole Fa in every bottom corner fitting F, the container Ct is transferred onto another container Ct. As mentioned above, while the twist lock 1 hangs from the bottom corner fitting F, the extreme ends of the locking members 53 retract into the passages 52 in the lower lock 5 which is positioned in agreement with and securely fixed to the lower fitting part 22 of the housing 2, as seen from above. Therefore, the lower lock 5 and the lower fitting part 22 can be accepted into the fitting hole Fa in the top corner fitting F of a lower container Ct. While the container Ct is being rested on another container, the upper lock 4 engaged with the fitting hole Fa (i.e. the spindle 3) comes down because of its own weight. At this stage, the bottom end of the spindle 3 comes in contact with the base ends of the locking members 53 which project into the guide hole 51, and outwardly forces the locking members 53 against the urging force of the springs 54, until the extreme ends thereof project from the surface of the lower lock 5. The locking members 53 thus engage with the fitting hole Fa in the top corner fitting F of the lower container Ct and prevent the release of the lower lock 5. In the end, the upper and lower containers Ct are connected by means of the twist locks 1, wherein the upper lock 4 is engaged with the fitting hole Fa in every bottom corner fitting F of the upper container Ct and the locking members 53 in the lower lock 5 are engaged with the fitting hole Fa in every top corner fitting F of the lower container Ct. For the completion of the loading, the upper container Ct is lowered until the bottom corner fittings F are rested on the housing 2.

The thus loaded containers Ct remain in the connected state, where the upper lock 4 is engaged with the fitting hole Fa in the bottom corner fitting F of the upper container Ct and the locking members 53 of the lower lock 5 are engaged with the fitting hole Fa in the top corner fitting F of the lower container Ct. In the unloading process, disconnection of the two containers is effected simply by lifting the upper container Ct in the connected state. When the upper container Ct is lifted up, the spindle 3 is raised together with the upper lock 4. Accordingly, the locking members 53 lose contact with the spindle 3 and retract their extreme ends into the passages 52 as urged by the springs 54. The lower lock 5 can be thus released from the fitting hole Fa in the top corner fitting F of the lower container Ct.

The container Ct is then transferred and suspended approximately one meter above the ground, where the upper lock 4 of the twist lock 1 is removed from the fitting hole Fa in every bottom corner fitting F of the container Ct. Release of the upper lock 4 is effected by manually pulling the stop handle S connected to the wire 7. With checking the stop handle S at the stop 23 in the housing 2, the upper lock 4 is rotated against the urging force of the torsion spring 6 to the position corresponding to the upper fitting part 21 of the housing 2, as seen from above. Thus, the twist lock 1 is made releasable from the fitting hole Fa in the bottom corner fitting F of the container Ct.

In some cases, the twist lock 1 may not be removed from the fitting hole Fa in the top corner fitting F of the lower container Ct, because of breakage or other unexpected accidents. In such emergency, the stop handle S connected to the wire 7 is manually pulled and checked at the stop 23 in the housing 2, so that the upper lock 4 rotates against the urging force of the torsion spring 6 and positionally agrees with the upper fitting part 21 of the housing 2, as seen from above. Finally, the upper container Ct can be lifted up, leaving the twist lock 1 on the lower container Ct. As the upper half of the twist lock 1 is exposed after the removal of the upper container Ct, it can be later removed from the fitting hole Fa in the top corner fitting F of the container Ct.

As described above, the first embodiment of the twist lock 1 works sufficiently in connecting two containers stored in a container yard Yd or the like, where no lift-up force acts on the twist lock 1. However, when this twist lock 1 is employed to connect upper and lower containers Ct loaded in a containership Sh, the influence of a lift-up force should be taken into consideration. As the containership Sh pitches or rolls owing to high waves in the sea, the containers Ct may jump up, imposing a lift-up force on the upper lock 4 engaged with the fitting hole Fa in the bottom corner fitting F of the upper container Ct. Such lift-up force pulls up the spindle 3, and may eventually cause disengagement of the locking members 53 in the lower lock 5 from the fitting hole Fa in the top corner fitting F of the lower container Ct.

Figure 4:
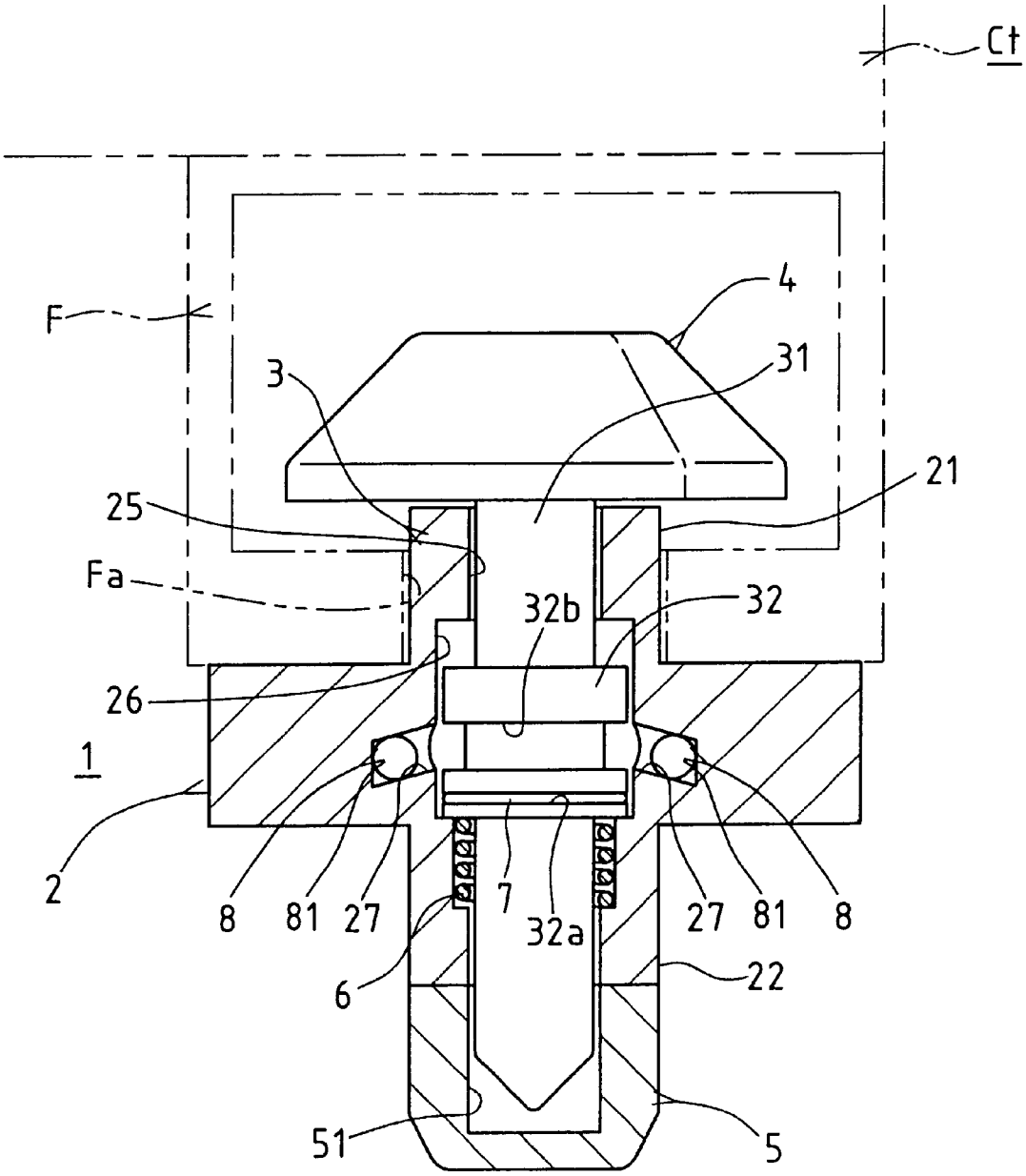
FIG. 4 is a longitudinal cross-sectional view of a twist lock according to the second embodiment of the present invention, vertically taken along the axial centres of the connecting bores.

FIG. 4 shows a twist lock 1 according to the second embodiment, which endures a lift-up force acting on the upper lock 4 and retains the connection between the upper and lower containers Ct, provided the inclination of the containers Ct exceeds a predetermined degree.

In the following description of the twist lock 1 according to the second embodiment, it should be understood that the description is focused on the difference from the first embodiment, and that the same constitutive elements are indicated by the same reference signs without giving any details.

The twist lock 1 of the second embodiment includes a safety unit 8 within the housing 2. The safety unit 8 comprises a pair of connecting bores 27 each being formed in a predetermined length and having an open end which faces the cavity 26 in the housing 2, and at least one ball 81 rotatably accommodated in each of the connecting bores 27. The connecting bores 27 are, as seen from above, formed in the direction extending from a diameter of the through-hole 25 and positionally arranged at a predetermined angle (e.g. 45 degrees) in the forward/backward direction. Further, the connecting bores 27 have a downward gradient of a predetermined degree (e.g. 5 degrees), descending from the open ends facing the cavity 26 to the terminal ends.

Additionally, a fitting groove 32*b* is formed on the outer circumferential surface of the large-diameter spindle part 32 of the spindle 3, at a position that does not interfere with the groove 32*a*. The fitting groove 32*b* faces the open ends of the connecting bores 27 which open to the cavity 26, when the spindle 3 stays at the lowered position on the bottom step defined by the through-hole 25 and the cavity 26. The configuration of the fitting groove 32*b* is designed in correspondence with the diameter of the ball 81.

When the containers Ct are level, the balls 81 roll down along the gradient of the connecting bores 27 to the terminal ends. The length of the connecting bores 27 is arranged such that the balls 81 at the terminal ends stay away from the fitting groove 32*b* of the spindle 3. Likewise, if a plurality of balls 81 are to be accommodated in each connecting bore 27, the inner balls 81 should stay away from the fitting groove 32*b* and be entirely accommodated in the connecting bores 27, when the outer balls 81 reach the terminal ends of the connecting bores 27.

Now, the operation of the twist lock 1 of the second embodiment is explained.

Referring to FIG. 4 which shows the initial state of the twist lock 1, the upper lock 4 is urged by the torsion spring 6 to be engaged with the fitting hole Fa in the corner fitting F of the container Ct. The balls 81 have rolled down along the gradient of the connecting bores 27 to the terminal ends. As the balls 81 stay away from the fitting groove 32*b*, the spindle 3 can move upwards.

The twist lock 1 in the initial state is attached to the fitting hole Fa in the corner fitting F of the container Ct in the same manner as in the first embodiment. The container Ct is then transferred onto another container Ct in such a manner that the lower locks 5 can enter the fitting hole Fa of the top corner fittings F of the lower container Ct. The upper and lower containers Ct are eventually connected by the upper lock 4 and the locking members 53 in the lower lock 5, wherein the upper lock 4 is engaged with the fitting hole Fa in every bottom corner fitting F of the upper container Ct and the locking members 53 are engaged with the fitting hole Fa in every top corner fitting F of the lower container Ct.

Due to high waves or the like, the inclination of the connected containers Ct may exceed the gradient of the connecting bores 27. In this case, the upward movement of the spindle 3 is blocked by at least one of the balls 81, which rolls up along the connecting bore 27 to be half fitted into the fitting groove 32b. If the containers Ct jump up to impose a lift-up force on the upper lock 4, the spindle 3 cannot move upwards in the locked state. Meanwhile, the locking members 53 of the lower lock 5 are kept engaged with the fitting hole Fa in the top corner fitting F of the lower container Ct, preventing the release of the lower lock 5. Consequently, the connection between the upper and lower containers Ct is maintained.

It should be noted that the connecting bores 27 are located at a predetermined angle (45 degrees in this embodiment) in the forward/backward direction of the twist lock 1. Owing to this arrangement, the safety unit 8 can respond to the inclination in every direction, whether the containers Ct are shaken in the right/left or forward/backward direction or in a composite direction thereof. As far as the degree of such inclination exceeds the gradient of the connection bores 27 in the axial direction thereof, the safety unit 8 allows at least one of the balls 81 to fit into the fitting groove 32*b* without fail. Since the upward movement of the spindle 3 is blocked in this manner, the upper and lower containers Ct are kept connected.

Moreover, when the containers Ct stay level, the balls 81 roll down along the connecting bores 27 to the terminal ends and stay away from the fitting groove 32*b* of the spindle 3. Therefore, in unloading the containers Ct, the upward movement of the spindle 3 is not hindered by an accidental operation of the safety unit 8.

Thereafter, the container Ct can be unloaded simply by lifting the container Ct in the same manner as in the first embodiment. As described above, the balls 81 stay away from the fitting groove 32*b* to permit the upward movement of the spindle 3. When the container Ct is lifted up, the upper lock 4 (i.e. the spindle 3) is raised by the bottom corner fitting F of the upper container Ct. On the arrival of the spindle 3 to the raised position, the locking members 53 retract into the passages 52 in the lower lock 5. As a result, the lower lock 5 becomes removable from the fitting hole Fa in the top corner fitting F of the lower container Ct.

Then, the container Ct is transferred and suspended approximately one meter above the ground, where the upper lock 4 of the twist lock 1 is removed from the fitting hole Fa in the bottom corner fitting F of the container Ct.

As has been disclosed with reference to FIG. 4, the twist lock 1 of the second embodiment is provided with the safety unit 8 comprising a pair of connecting bores 27 formed within the housing 2, and the balls 81 rotatably accommodated in the connecting bores 27. When the inclination of the containers Ct exceeds a predetermined degree, at least one of the balls 81 fits into the fitting groove 32*b* formed in the spindle 3 to cope with the lift-up force imposed on the upper lock 4. Alternatively, the safety unit 8 may situate in the spindle 3, while the fitting groove is formed in the housing 2.

Figure 5:
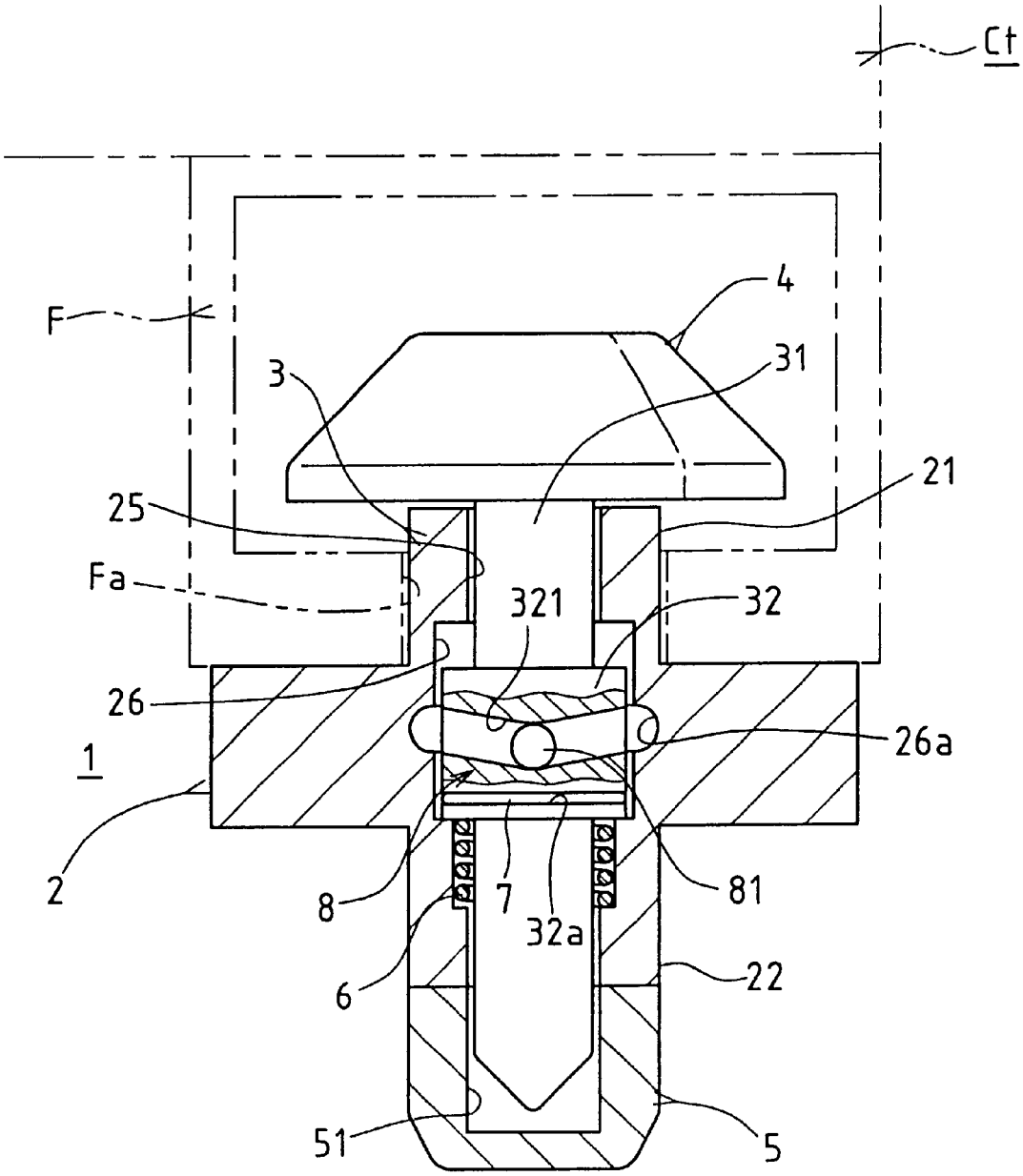
FIG. 5 is a longitudinal cross-sectional view of a twist lock according to a modification of the second embodiment of the present invention, vertically taken along the axial centres of the connecting bores.

As shown in FIG. 5, an alternative safety unit 8 is provided in the spindle 3, and comprises a pair of connecting bores 321 formed in a diameter direction of the large-diameter spindle part 32 and a ball 81 rotatably accommodated in the connecting bores 321. A fitting groove 26*a* is formed in the inner circumferential surface of the cavity 26 of the housing 2, wherein the fitting groove 26*a* faces the open ends of the connecting bores 321 in the spindle 3 at the lowered position, and shaped in correspondence with the diameter of the ball 81. When the upper lock 4 is engaged with the engaging hole Fa in the bottom corner fitting F of the container Ct, the connecting bores 321 are positioned at a predetermined angle (e.g. 45 degrees) in the forward/backward direction as seen from the top, with a downward gradient of a predetermined degree (e.g. 5 degrees) from both open ends to the centre.

This alternative embodiment operates in the same manner as the above embodiment. When the inclination of the containers Ct exceeds the gradient of the connecting bores 321, the ball 81 accommodated therein rolls along either of the connecting bores 321 to fit into the fitting groove 26*a* in the housing 2. By engaging with the fitting groove 26*a* as well as the connecting bore 321, the ball 81 blocks the upward movement of the spindle 3.

In the twist locks 1 of the second embodiments shown by FIGS. 4 and 5, as seen from the top, the connecting bores 27 run in the direction extending from a diameter of the through-hole 25, while the connecting bores 321 run in a diameter direction thereof. Besides, the connecting bores 27, 321 are positioned at an angle of 45 degrees in the forward/backward direction. Apparently, the direction of the connecting bores 27, 321 should not be limited to a diameter direction of the through-hole 25 or the direction extending from a diameter thereof, wherein the open ends of the connecting bores 27, 321 being situated 180 degrees apart from each other. Moreover, the connecting bores 27, 321 are not necessarily positioned at an angle of 45 degrees in the forward/backward direction. In addition, the connecting bores 27, 321 may provided in one or plurality, and the gradient thereof may be other than 5 degrees.

In other words, as the connecting bores 27, 321, at least one bore is formed respectively in the right component and the left component of the housing 2 and optionally angled in the forward/backward direction, assuming that the upper lock 4 engages with the fitting hole Fa in the top corner fitting F of the container Ct and also that the spindle 3 stays at the lowered position. However, if the connecting bores 27, 321 are formed in the right/left direction, which is perpendicular to the forward/backward direction, the safety unit 8 can operate against a lift-up force in the right/left direction deriving from the inclination of containers Ct, but may fail to operate against a lift-up force in the forward/backward direction. In this case, an additional pair of connecting bores 27, 321 should be formed in the forward/backward direction to compensate for the disadvantage.

In the twist locks 1 according to the second embodiment and its alternative embodiment, the ball 81 fits into the fitting groove 32*b* and locks the spindle 3 against the lift-up force imposed thereon, when the inclination of the containers Ct exceeds the gradient of the connecting bores 27, 321. However, if the inclination of the containers Ct is less than the gradient of the connecting bores 27, 321, the spindle 3 may yield to the lift-up force and come off.

Figure 6:
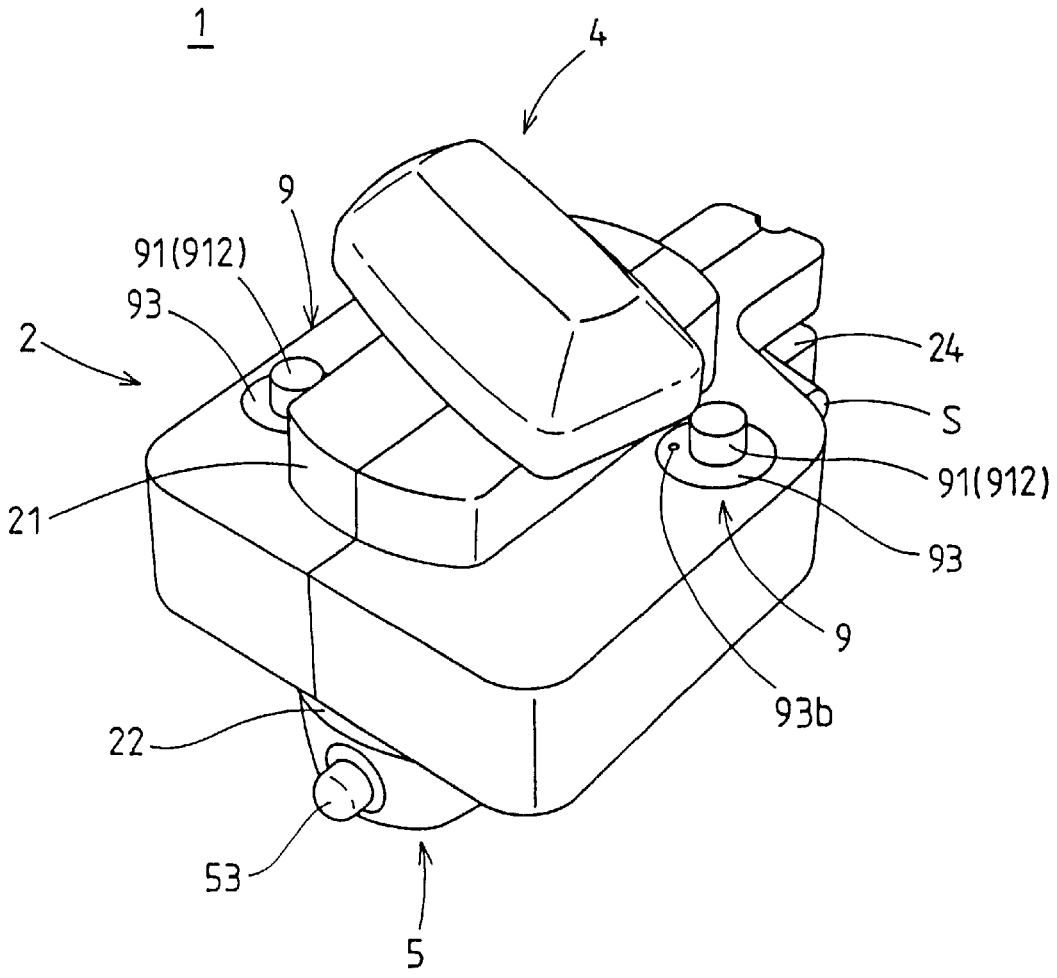
FIG. 6 is an entire perspective view of a twist lock according to the third embodiment of the present invention.
Figure 7:
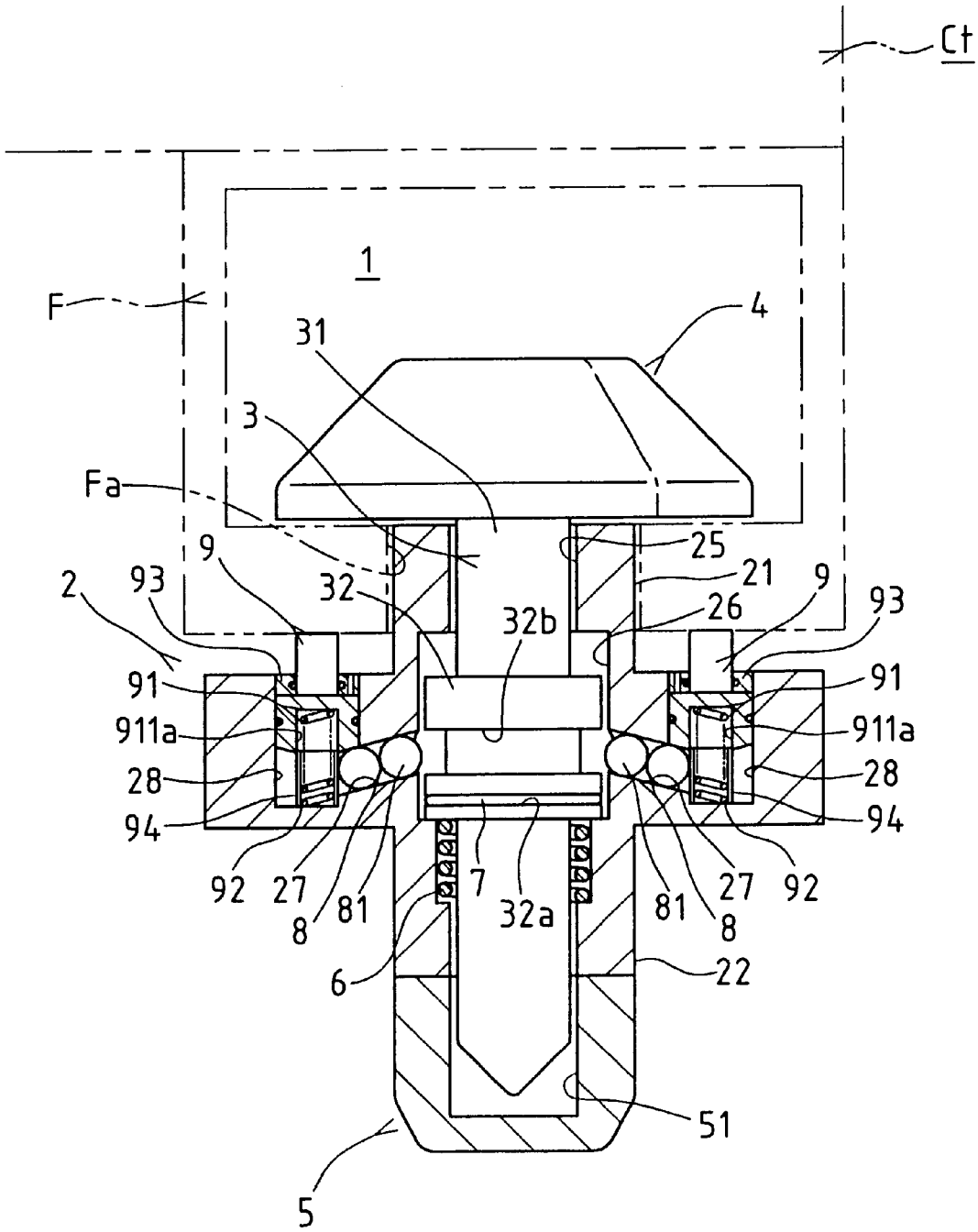
FIG. 7 is a longitudinal cross-sectional view of the twist lock of FIG. 6, vertically taken along a straight line linking the centres of the guides.

FIGS. 6 and 7 illustrate a twist lock 1 according to the third embodiment, which endures a lift-up force acting on the upper lock 4 and retains the connection between the upper and lower containers Ct, even when the inclination of the containers Ct does not exceed the gradient of the connecting bores 27.

In the following description of the twist lock 1 according to the third embodiment, it should be understood that the description is focused on the difference from the preceding embodiments, and that the same constitutive elements are indicated by the same reference signs without giving any details.

The twist lock 1 of the third embodiment further includes an operation control unit 9 formed in the housing 2 for controlling the displacement of the balls 81 in the safety unit 8. The operation control unit 9 comprises a pair of fitting bores 28 vertically formed on the right and left sides of the upper fitting part 21 and positioned 180 degrees apart from each other along a concentric circle of the through-hole 25, with the bottom ends of the fitting bores 28 communicating with the connecting bores 27, guides 91 fitted in the fitting bores 28 in a vertically slidable manner, spring means (e.g. springs 92) disposed between the guides 91 and the fitting bores 28, stoppers 93 provided at the top ends of the fitting bores 28 for preventing the detachment of the guides 91, and sleeves 94 for housing the springs 92. Each guide 91 has a conical bottom surface and is slidably inserted in the fitting bores 28. The guide 91 comprises a guide body 911, a holding bore 911*a* formed therein, and a pin 912 upwardly projecting from the top surface of the guide body 911. The guide 91 is capable of sliding vertically along the fitting bore 28, with accommodating the sleeve 94 in the holding bore 911*a* of the guide body 911. The pin 912 is slidably fitted in an insertion hole 93*a* formed in the stopper 93, and usually projects beyond the top surface of the housing 2 by the urging force of the spring 92.

Figure 8:
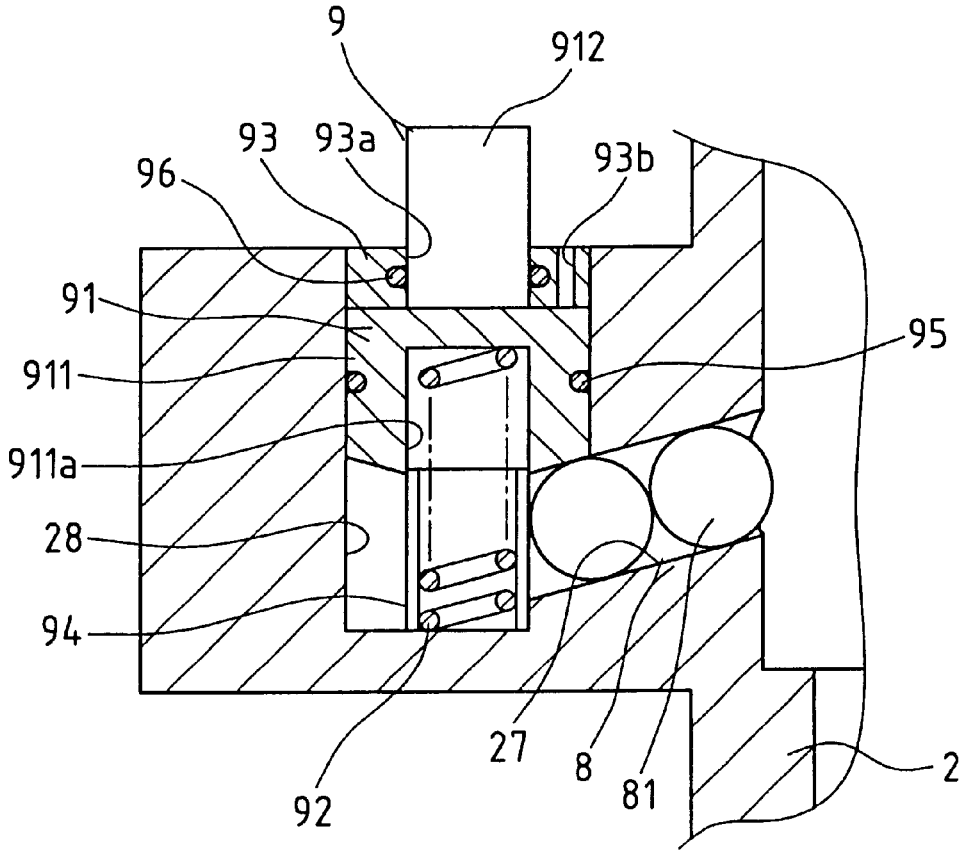
FIG. 8 is an enlarged view showing the safety unit and the operation control unit in the twist lock of FIG. 7.

As shown in FIG. 8 in detail, O-rings 95, 96 are arranged around the outer circumferential surface of the guide body 911 of the guide 91 and the inner circumferential surface of the insertion hole 93*a* of the stopper 93, respectively. The stopper 93 is formed with a choke 93*b* running in the vertical direction. This structure provides an air damper effect to the guide 91. Specifically speaking, when the guide 91 slides upwards as urged by the spring 92, the air in a space enclosed by the stopper 93, the fitting bore 28 and the guide 91 is compressed through the choke 93*b*. Accordingly, the guide 91 functions as an air damper and rises slowly. As will be described later, in the twist lock 1, the guides 91 are pressed down to the lowered position by the bottom corner fitting F of the container Ct which rests on the housing 2. The containers Ct in the resting state may suddenly jump or shake, whereas the guides 91 rise slowly and do not follow the sudden jump of the containers Ct.

Figure 9:
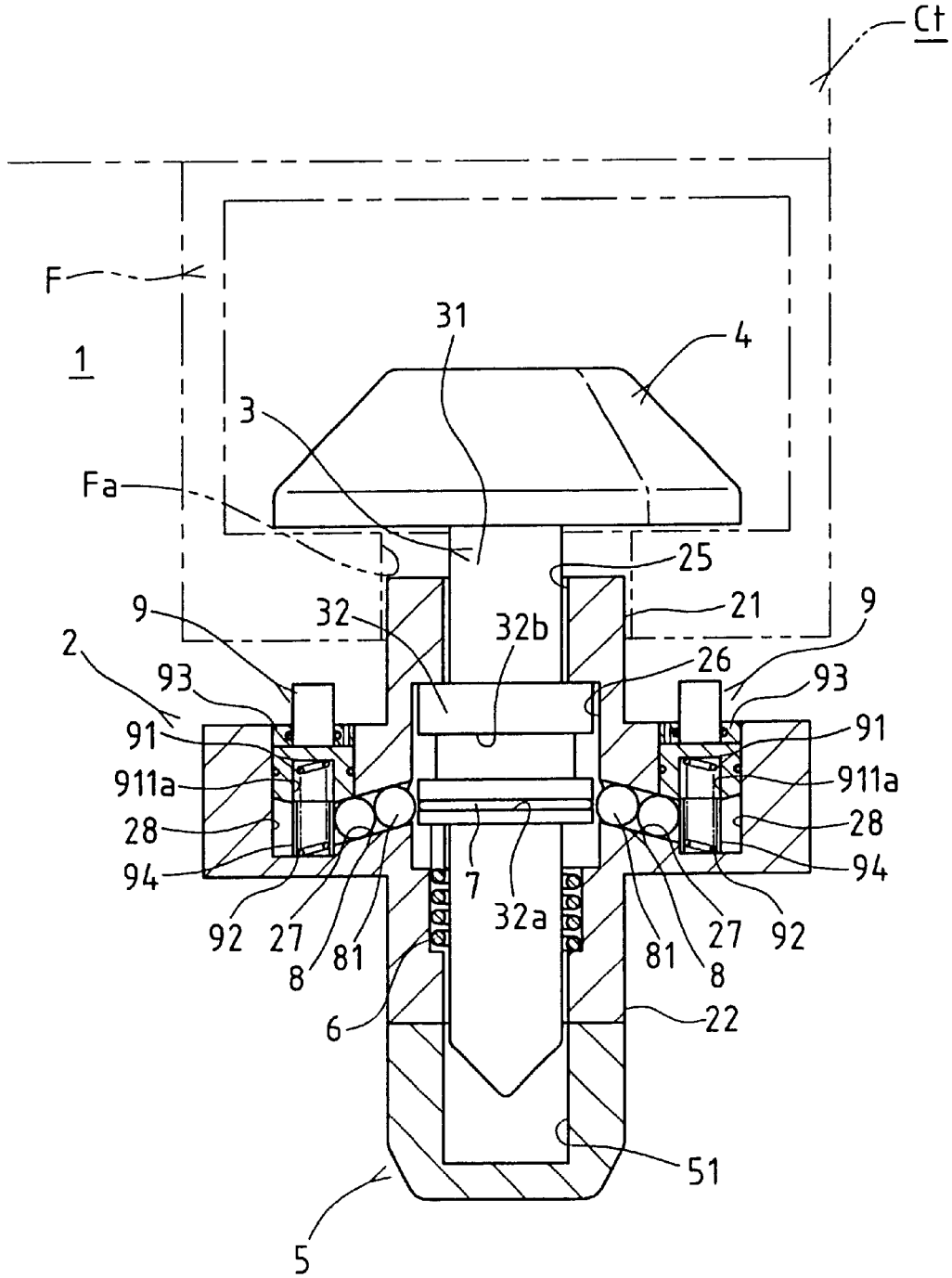
FIG. 9 is a cross-sectional view of the twist lock of FIG. 6, as mounted in the fitting hole in a bottom corner fitting of a container.
Figure 10:
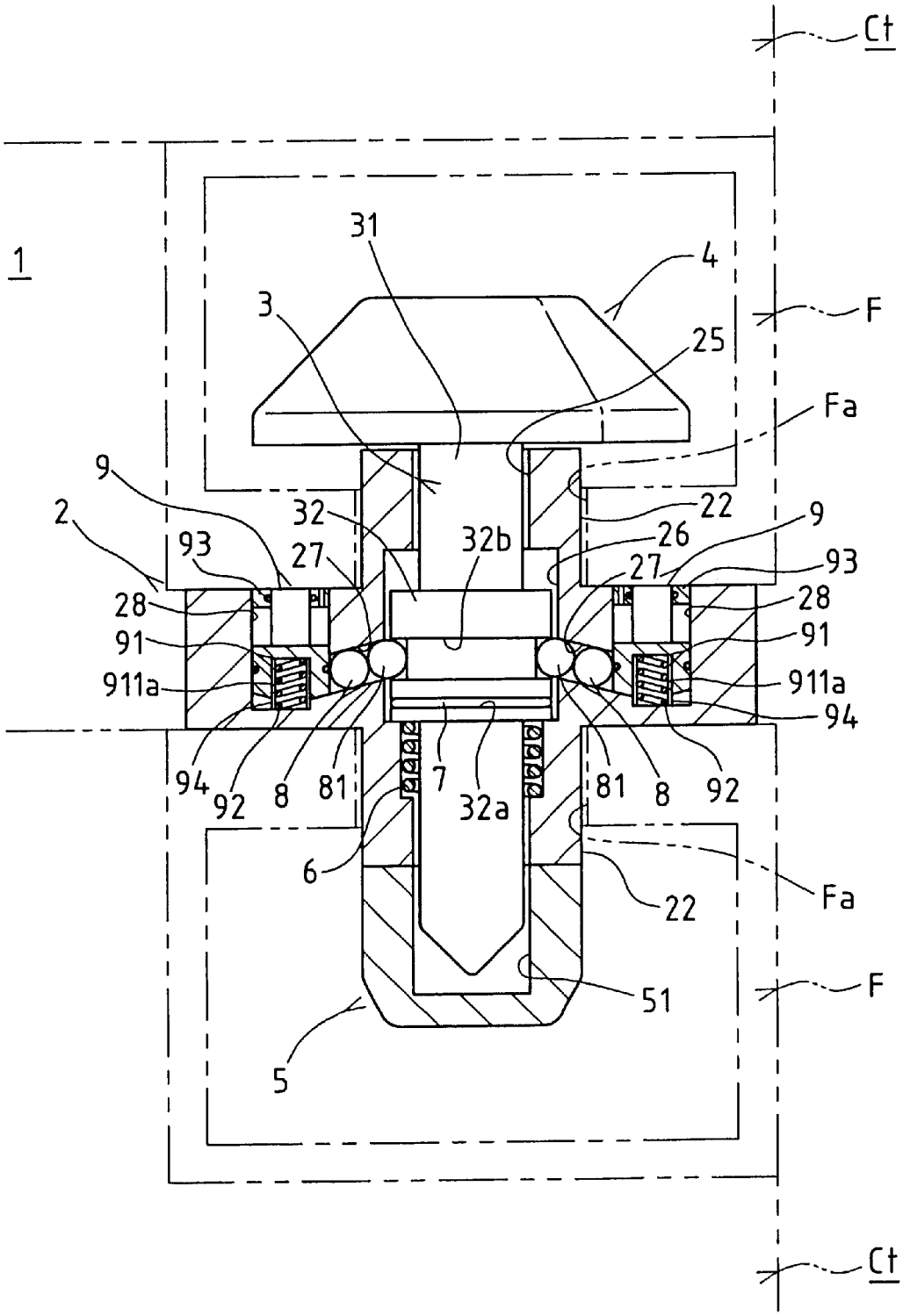
FIG. 10 is a cross-sectional view of the twist lock of FIG. 6 in the interconnecting state with containers.
Figure 11:
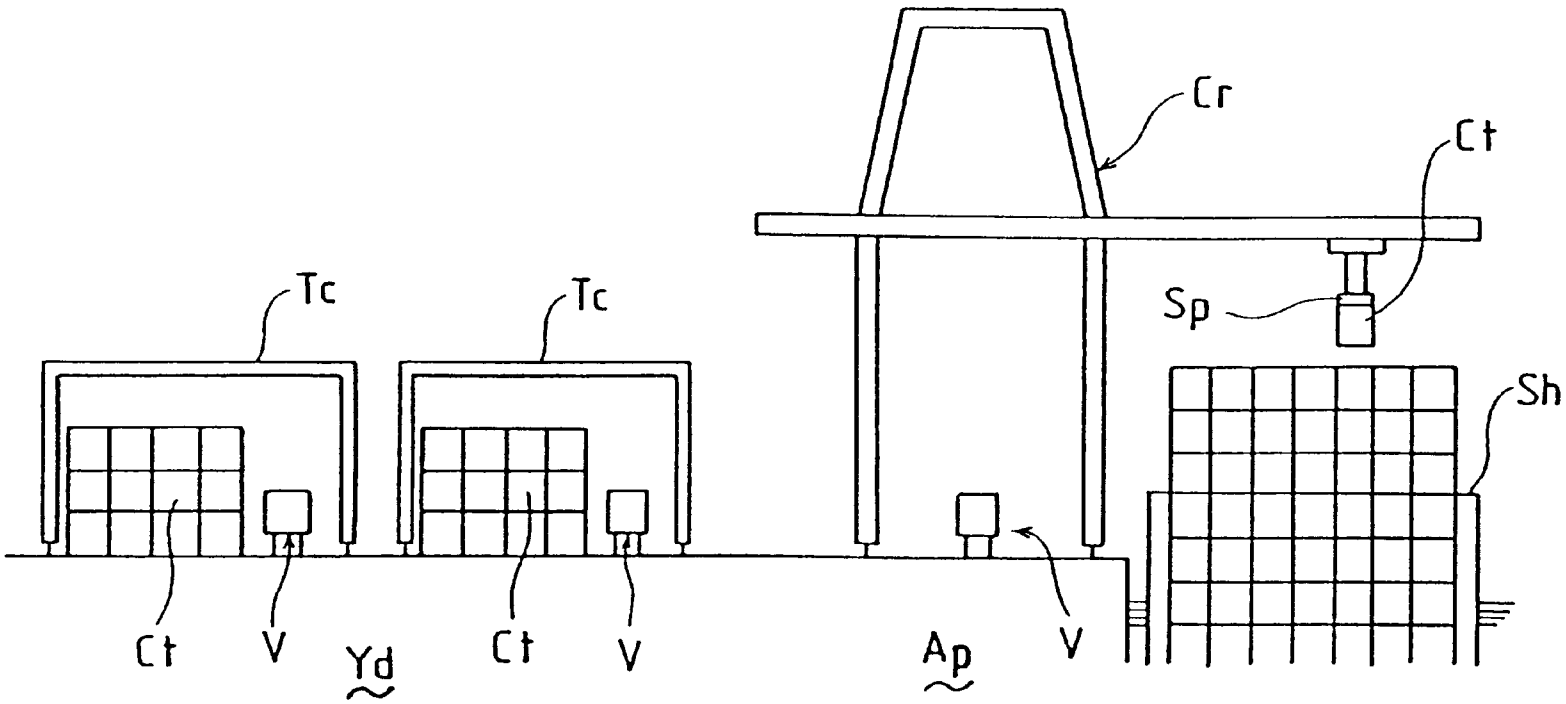
Fig. 11 PRIOR ART
FIG. 11 is a schematic diagram showing transfer of a container between the container yard and the apron by means of a container vehicle, and loading and unloading of a container between the container vehicle and the containership by means of the container crane.
Figure 12:
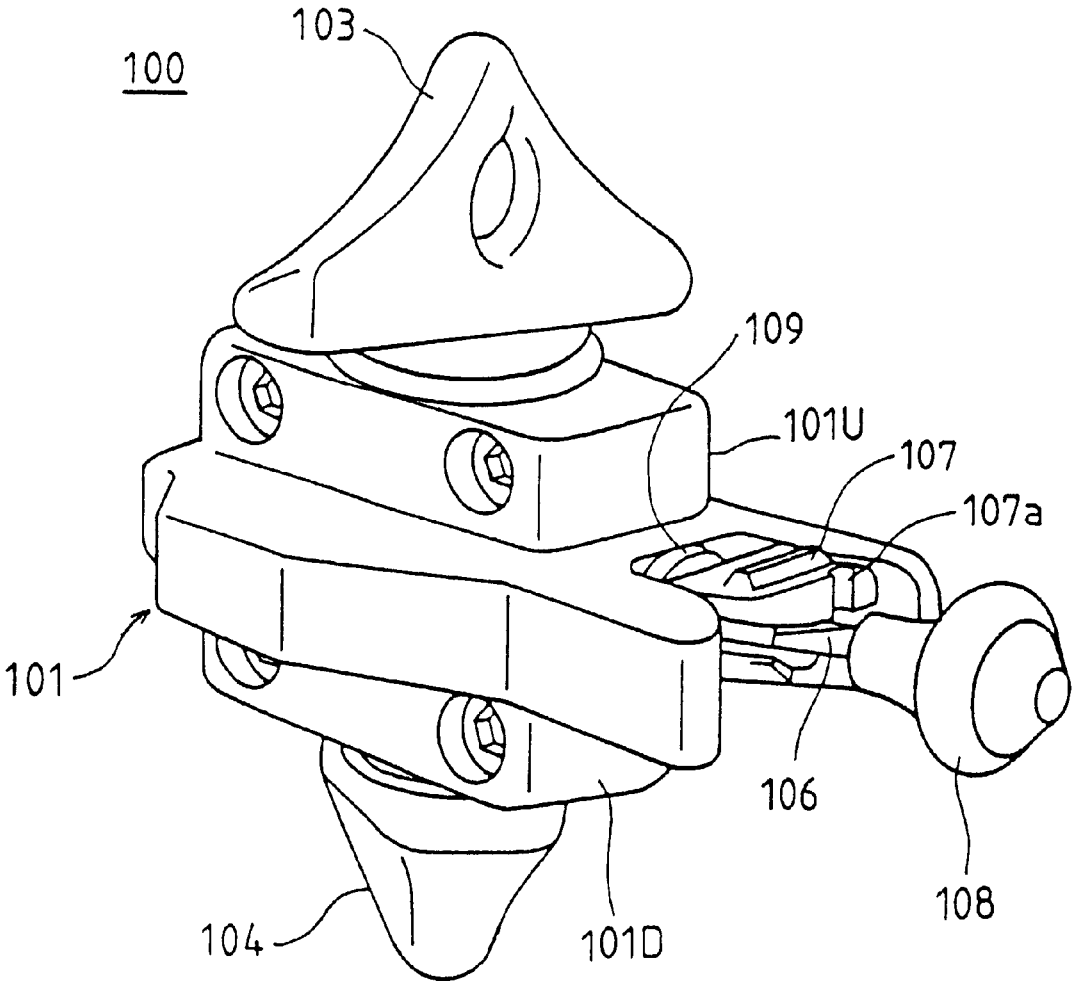
Fig. 12 PRIOR ART
FIG. 12 is a perspective view of a conventional twist lock for joining containers.
Figure 13:
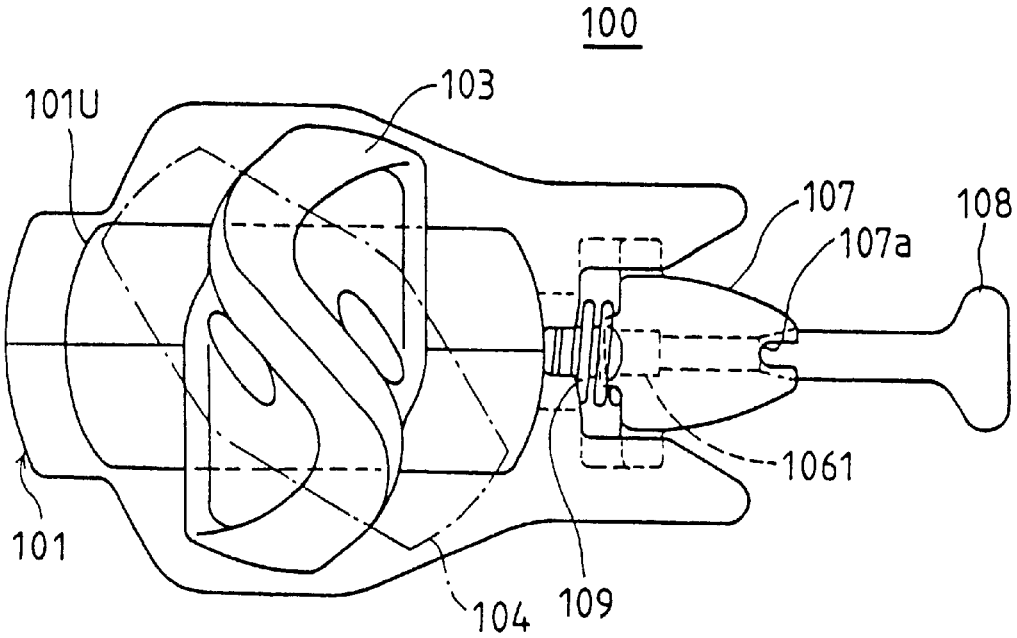
Fig. 13 PRIOR ART
FIG. 13 is a plan view of the twist lock of FIG. 12.
Figure 14:
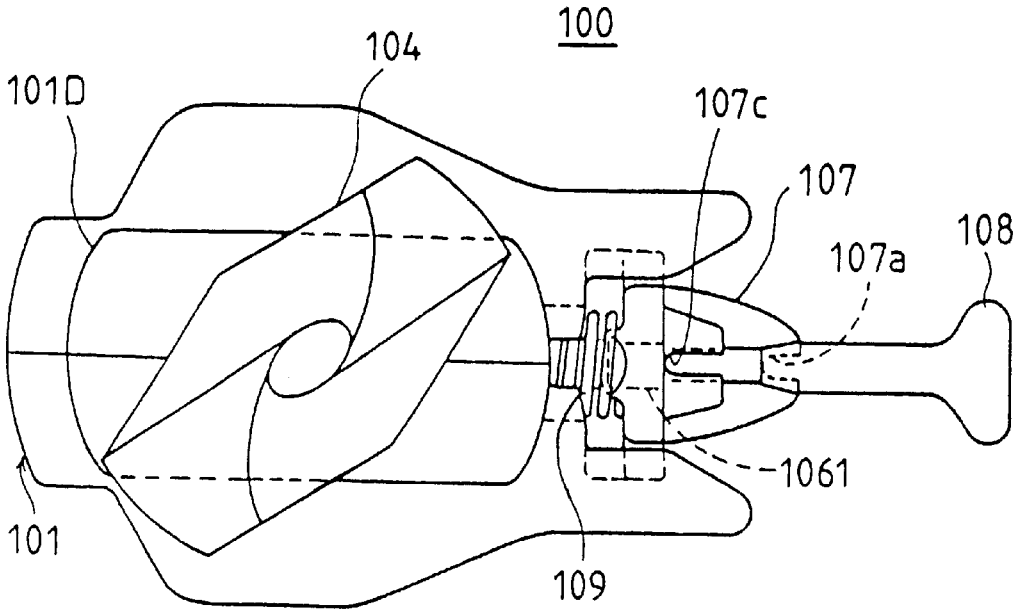
Fig. 14 PRIOR ART
FIG. 14 is a bottom view of the twist lock of FIG. 12.
Figure 15:
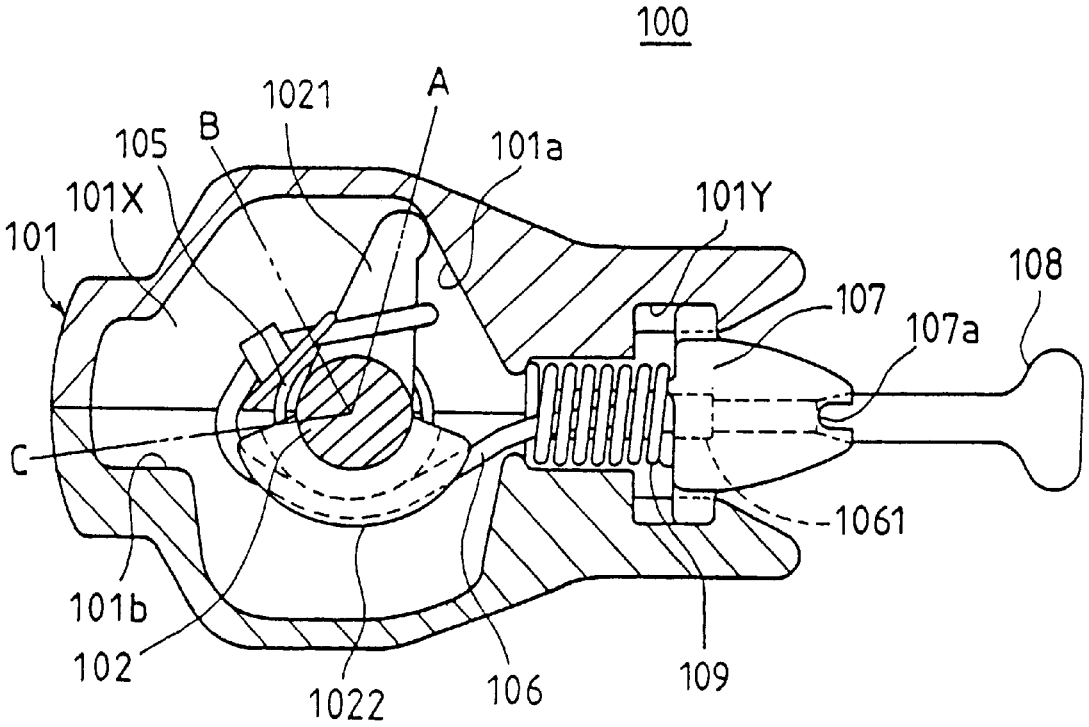
Fig. 15 PRIOR ART
FIG. 15 is a transverse cross-sectional view of the twist lock of FIG. 12.
Figure 16:
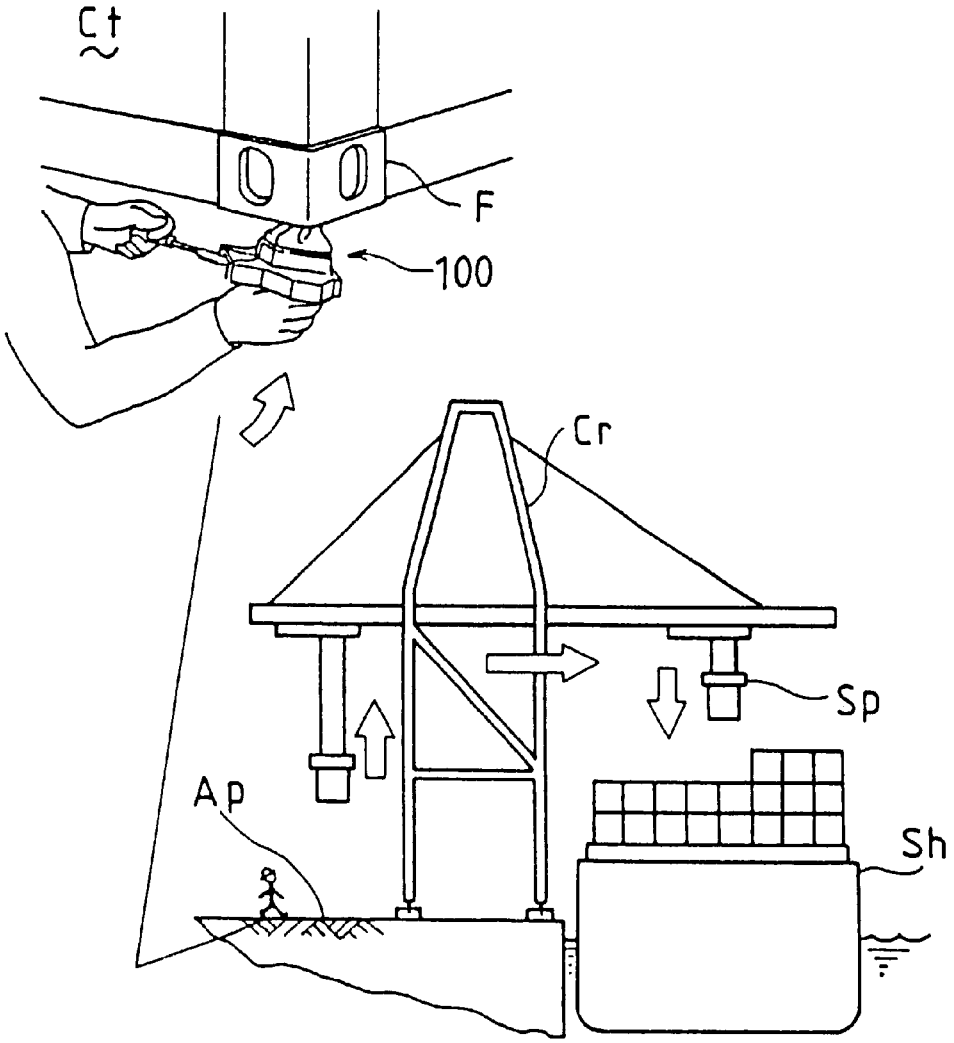
FIG. 16 is a schematic diagram showing the attachment of the twist lock of FIG. 12 and the loading of the container.
Figure 17:
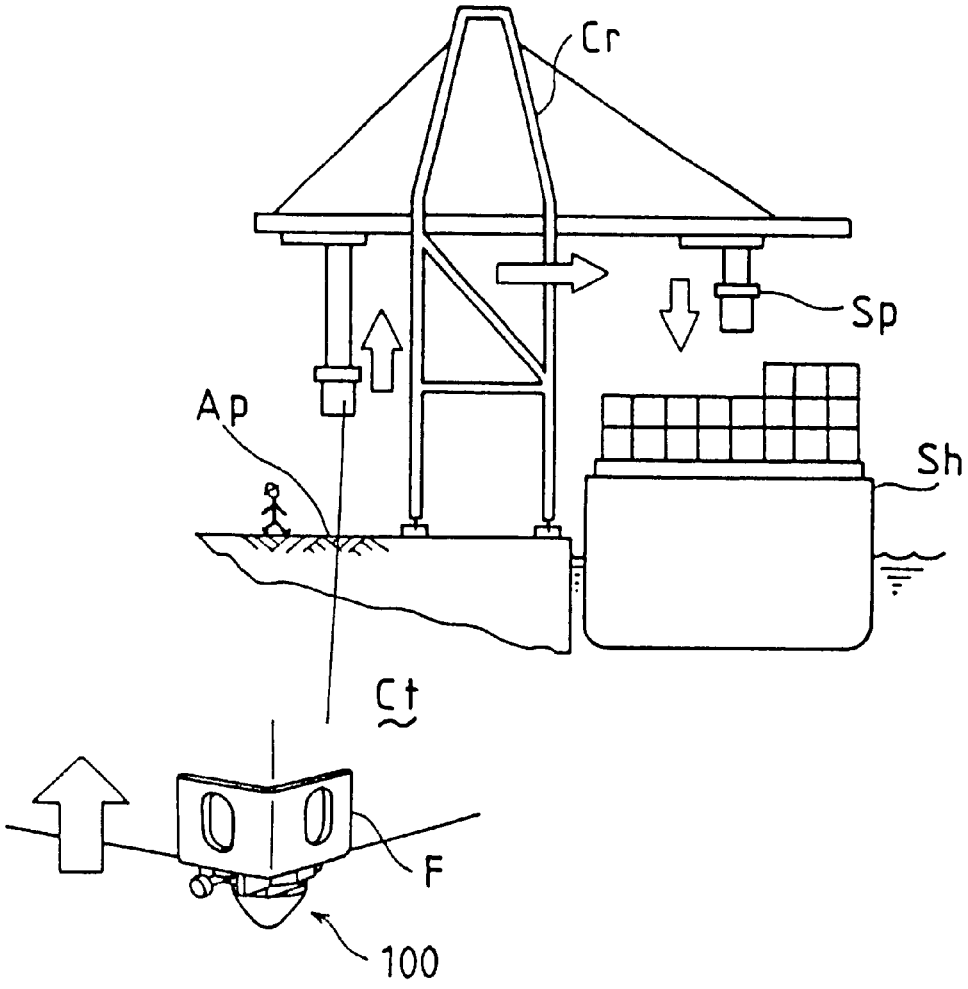
FIG. 17 is a schematic diagram showing the attachment of the twist lock of FIG. 12 and the loading of the container.
Figure 18:
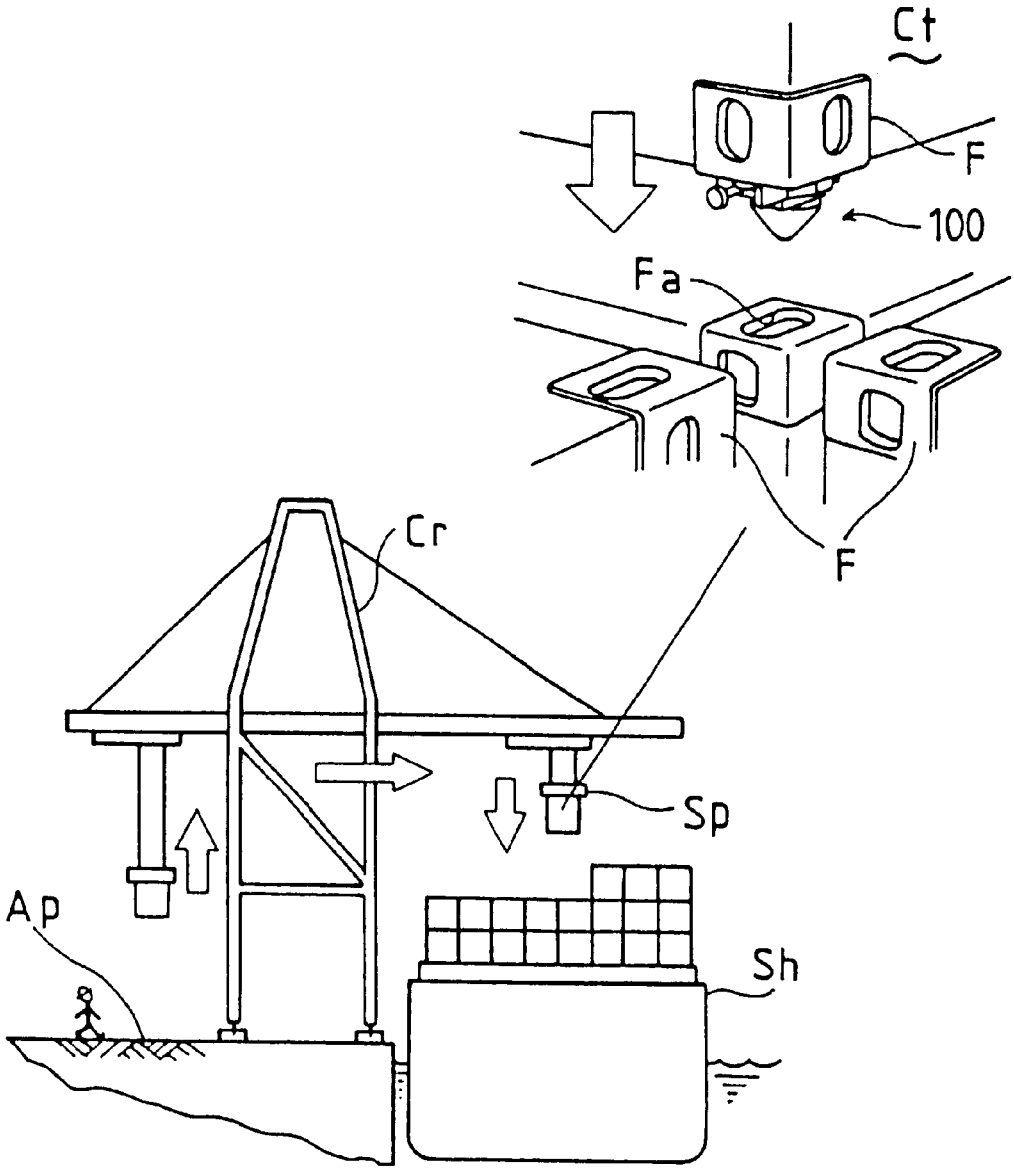
FIG. 18 is a schematic diagram showing the attachment of the twist lock of FIG. 12 and the loading of the container.
Figure 19:
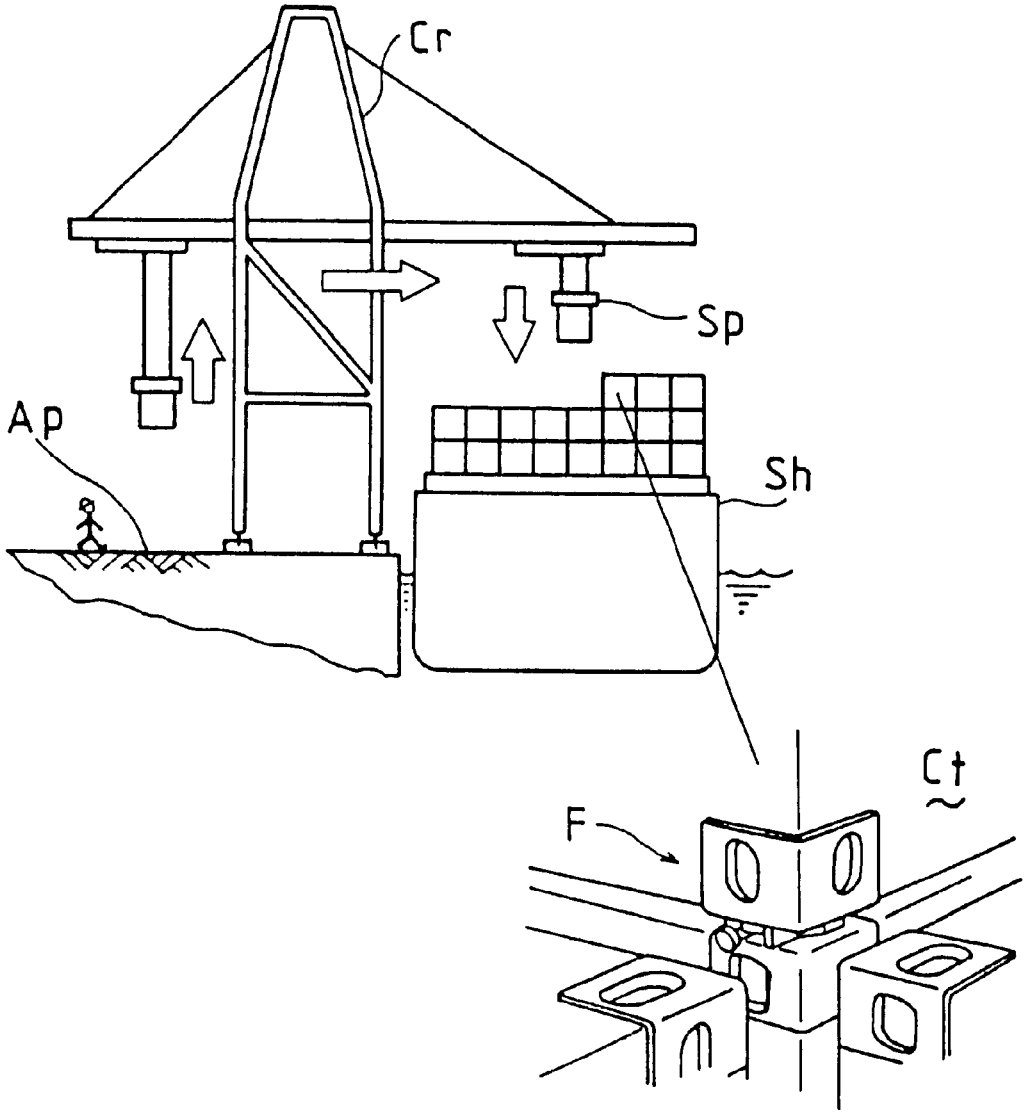
FIG. 19 is a schematic diagram showing the attachment of the twist lock of FIG. 12 and the loading of the container.
Figure 20:
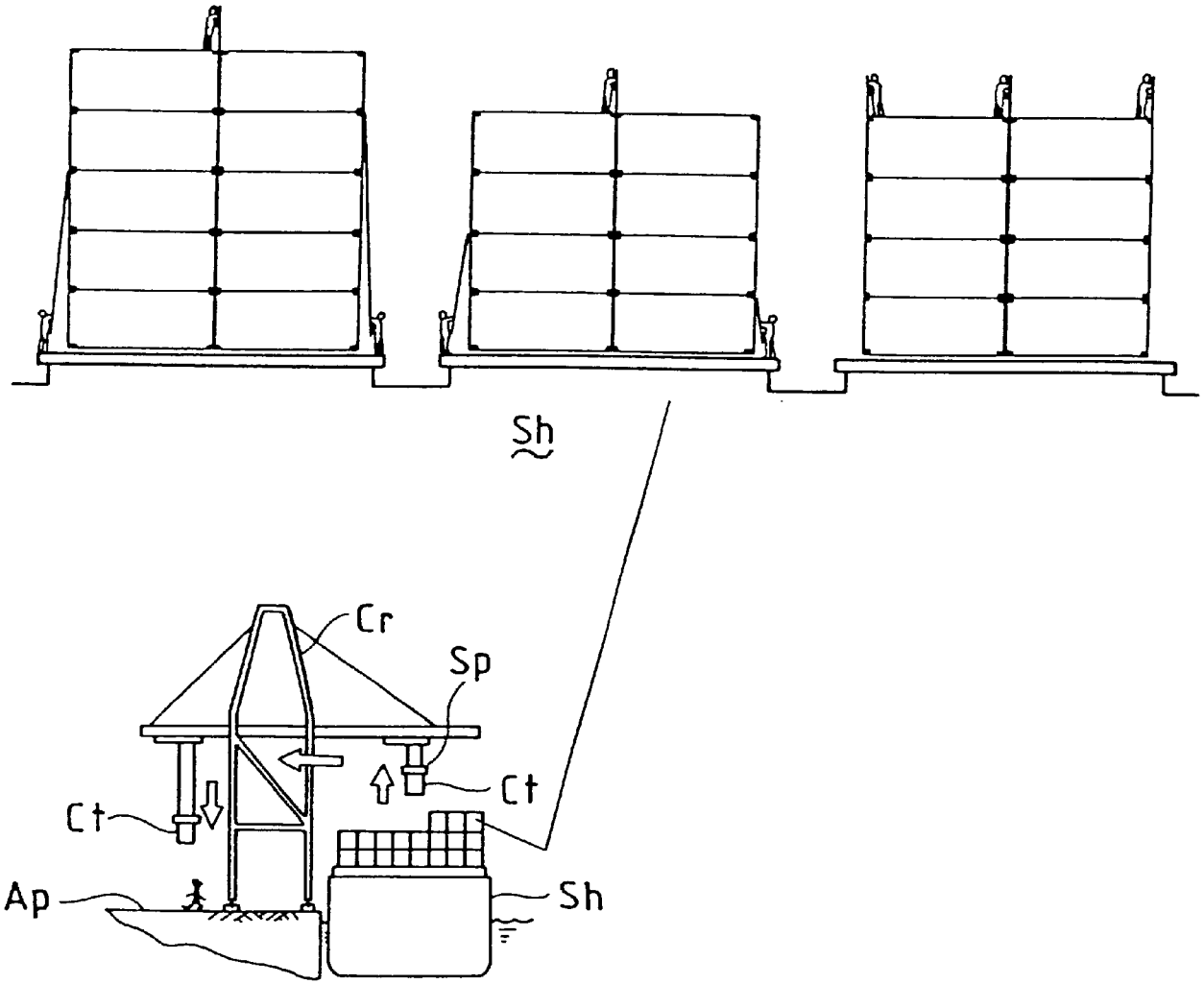
FIG. 20 is a schematic diagram showing the unloading of a container connected by the twist lock of FIG. 12 from the containership.
Figure 21:
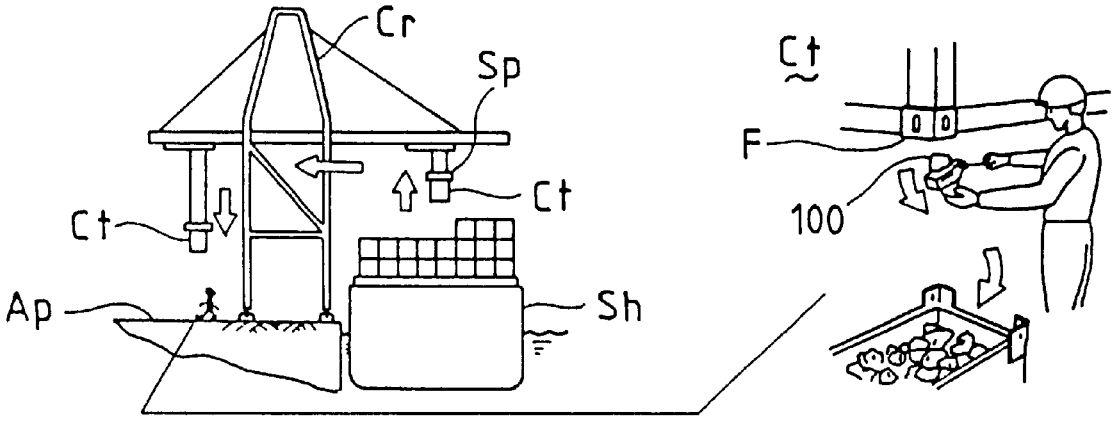
FIG. 21 is a schematic diagram showing the unloading of a container connected by the twist lock of FIG. 12 from the containership.

In the safety unit 8 of the third embodiment, each connecting bore 27 accommodates a plurality of balls 81. In FIGS. 7 and 9, the guides 91 are raised by the urging force of the springs 92 and contact the stoppers 93. In this case, the outer balls 81 roll down along the connecting bores 27 and stop on contact with the sleeves 94, whereby the inner balls 81 roll out of the fitting groove 32*b* to be accommodated in the connecting bores 27. In FIG. 10, on the other hand, the guides 91 are pressed down against the urging force of the springs 92. In this case, the outer balls 81 are pushed up along the connecting bores 27 and contact the outer circumferential surfaces of the guides 91, whereby the inner balls 81 fit in the fitting groove 32*b*. Since the inner balls 81 are engaged with the connecting bores 27 as well as the fitting groove 32*b*, the spindle 3 cannot move upwards. The length of the connecting bores 27 is decided to achieve the above results.

In this twist lock 1, the height of the upper fitting part 21 and the degree of the projection of the pins 912 which project from the top surface of the housing 2 depend on the thickness of the corner fitting F of the container Ct. Such dimensions should be determined to effect the following operations. In the first place, when the spindle 3 stays at the lowered position, the projections of the pins 912, which project from the top surface of the housing 2 by the urging force of the springs 92, should not interfere with the insertion and engagement of the upper lock 4, so that the upper lock 4 can be inserted into the fitting hole Fa in the corner fitting F of the container Ct and engaged therewith as urged by the torsion spring 6. Secondly, when the pins 912 are pressed against the urging force of the springs 92 by the bottom fitting part F of the upper container Ct which rests on the housing 2, the gap between the bottom surface of the upper lock 4 and the opposite inner surface of the bottom corner fitting F is greater than the projections of the pins 912.

Now, the operation of the twist lock 1 of the third embodiment is explained.

FIGS. 6 and 7 illustrate the initial state of the twist lock 1. The upper lock 4 is urged by the torsion spring 6 to a position engaging with the fitting hole Fa of the corner fitting F of the container Ct. The guides 91 are raised to contact the stoppers 93 by the urging force of the springs 92, with the pins 912 projecting from the top surface of the housing 2. The balls 81 in the safety unit 8 have rolled down along the connecting bores 27, whereby the inner balls 81 roll out of the fitting groove 32*b* to be accommodated in the connecting bores 27. As the inner balls 81 do not interfere with the spindle 3, the spindle 3 is upwardly movable in the initial state. This twist lock 1 can be attached to the fitting hole Fa in the corner fitting F of the container Ct in the same manner as the above embodiments. Firstly, the upper lock 4 is twisted to the position corresponding to that of the upper fitting part 21 of the housing 2 as seen from above, and then the upper lock 4 and the upper fitting part 21 are inserted together into the fitting hole Fa in the bottom corner fitting F of the container Ct (FIG. 7).

Once the upper lock 4 enters the fitting hole Fa, the spindle 3 is urged back to the original position by the torsion spring 6, effecting the engagement of the upper lock 4 with the fitting hole Fa in the bottom corner fitting F. The twist lock 1 now hangs down by itself if it is no longer supported by hand, in which case the housing 2 descends relative to the upper lock 4 (i.e. the spindle 3) (FIG. 9). Prior to this relative displacement, the outer circumferential surface of the spindle 3 contacts the base ends of the locking members 53 and blocks their projection. As a result of the relative displacement, the locking members 53 project into the guide hole 51 as urged by the springs 54, with retracting the extreme ends into the passages 52 in the lower lock 5.

After the twist locks 1 are attached to the fitting hole Fa of the bottom corner fittings F of the container Ct, the container Ct is lifted and transferred onto another container Ct. As mentioned above, the extreme ends of the locking members 53 retract into the passages 52 in the lower lock 5 which is in positional agreement with and fixed to the lower fitting part 22 of the housing 2, as seen from above. Therefore, the lower lock 5 and the lower fitting part 22 can be accepted into the fitting hole Fa in the top corner fitting F of the lower container Ct.

As the upper container Ct descends further, the upper lock 4 (i.e. the spindle 3) yields to its own weight and reaches the lowered position, at which position the bottom end of the spindle 3 comes in contact with the base ends of the locking members 53 projecting into the guide hole 51. Thus, the locking members 53 are pushed outwardly against the urging force of the springs 54, until the extreme ends project from the surface of the lower lock 5. While the container Ct is lowered still further, the bottom corner fitting F of the upper container Ct presses down the pins 912 together with the guides 91 against the urging force of the springs 92 and finally rests on the housing 2. In association with the descent of the guides 91, the bottom ends of the guide bodies 911 push the outer balls 81 into the connecting bores 27, and the outer balls 81 push the inner balls 81 into the fitting groove 32*b*. Each of the inner balls 81 is half fitted in the fitting groove 32*b* of the spindle 3 and half fitted in the connecting bore 27, thereby blocking the upward movement of the spindle 3 (FIG. 10). In this state, the locking members 53 are engaged with the fitting hole Fa in the top corner fitting F of the lower container Ct to prevent the release of the lower lock 5. As a result, the upper and lower containers Ct are connected by the upper lock 4 and the locking members 53 of the lower lock 5, while the upward movement of the spindle 3 is blocked, wherein the upper lock 4 is engaged with the fitting hole Fa in every bottom corner fitting F of the upper container Ct and the locking members 53 are engaged with the fitting hole Fa in every top corner fitting of the lower container Ct.

Incidentally, the containers Ct connected by the twist locks 1 may be shaken due to high waves in the sea or the like. When the inclination of the containers Ct exceeds the gradient of the connecting bores 27 in the axial direction, the safety unit 8 operates as described in the second embodiments. That is, one of the balls 81 fits in the fitting groove 32*b* to block the upward movement of the spindle 3. Therefore, the locking members 53 of the lower lock 5 remain engaged with the fitting hole Fa in the top corner fitting F of the lower container Ct, thereby maintaining the connection between the upper and lower containers Ct.

On the other hand, the inclination of the containers Ct may not exceed the gradient of the connecting bores 27. In this case, the guides 91 do not follow the sudden jump or shake of the containers Ct, and instead rise slowly according to the air damper effect based on the combination of the guides 91, the stoppers 93 and the fitting bores 28. Thus, irrespective of the sudden jump or shake of the containers Ct, the balls 81 remain fitted in the fitting groove 32*b* of the spindle 3 for a certain period of time, with blocking the upward movement of the spindle 3. As a result, the two containers Ct are kept connected.

It should be understood that the container Ct jumps up only for a moment. This means that the container Ct comes down to press the pins 912 of the guides 91 again, before the slowly rising guides 91 contact the stoppers 93, or, in other words, before the inner balls 81 roll out of the fitting groove 32*b* of the spindle 3. Therefore, the inner balls 81 remain in the fitting groove 32*b*.

Thereafter, unloading is performed by lifting the container Ct. First, the bottom corner fitting F of the upper container Ct leaves the top surface of the housing 2. At the same time, the guides 91 rise slowly as urged by the springs 92 and come in contact with the stoppers 93. Upon this contact, the outer balls 81 roll down along the connecting bores 27 and contact the sleeves 94, while the inner balls 81 roll out of the fitting groove 32*b*, thereby permitting free upward movement of the spindle 3. In this embodiment, the container Ct is to be lifted at a rate corresponding to the controlled rise of the guides 91. As the upper container Ct is further lifted up, the upper lock 4 is raised by the bottom corner fitting F of the upper container Ct to pull up the spindle 3 to the raised position. At this stage, the locking members 53 lose contact with the outer circumferential surface of the spindle 3, and retract the extreme ends into the passages 52 in the lower lock 5 as urged by the springs 54. Consequently, the locking members 53 of the lower lock 5 are disengaged from the fitting hole Fa in the top corner fitting F of the lower container Ct. By lifting the upper container Ct, the lower lock 5 comes out of the fitting hole Fa in the top corner fitting F of the lower container Ct.

Then, the container Ct is transferred and suspended at a height of approximately one meter above the ground, where the upper lock 4 of the twist lock 1 is removed from the fitting hole Fa in every bottom corner fitting F of the container Ct.

It should be borne in mind that the mode of the third embodiment should not be limited to the above disclosure. Apparently, the direction of the connecting bores 27 is not limited to the direction extending from a diameter of the through-hole 25, wherein the open ends of the connecting bores 27 being situated 180 degrees apart from each other. Moreover, the connecting bores 27 are not necessarily positioned at 45 degrees in the forward/backward direction. In addition, the connecting bores 27 may be provided in one or plurality, and the gradient thereof may be other than 5 degrees.

What is claimed is:

1. A twist lock for connecting containers which comprises:

a housing integrally including an upper fitting part and a lower fitting part each being capable of fitting into a fitting hole in a corner fitting of a container, and being formed with a through-hole which extends through the upper and lower fitting parts, a spindle inserted in the through-hole and being rotatable and vertically displaceable, an upper lock connected to a top end of the spindle and being engageable with the fitting hole in the corner fitting of the container, and a lower lock positioned in agreement with and fixed securely to the lower fitting part of the housing, the lower lock comprising a plurality of locking members slidably fitted in the lower fitting part which can engage with and disengage from the fitting hole in the corner fitting of the container, the spindle being urged by a spring member in such a direction that the upper lock can engage with the fitting hole in the corner fitting of the container, and each of the locking members being urged by another spring member in such a direction that each locking member can retract into the lower lock, wherein, provided that the spindle is positioned at a lowered position, the locking members contact the spindle and project from the lower lock against the urging force of the spring means, thereby engaging with the fitting hole in the corner fitting of the container to prevent the release of the lower lock, and wherein, provided that the spindle is positioned at a raised position, the locking members lose contact with the spindle and retract into the lower lock by the urging force of the other spring member, thereby disengaging from the fitting hole in the corner fitting of the container to permit the release of the lower lock.

2. A twist lock according to claim 1, wherein the spindle is linked with a stop handle through a linking member, and the housing includes a stop for checking the stop handle.

3. A twist lock according to claim 1 or 2, wherein a fitting groove is formed in an outer circumferential surface of the spindle, and at least one connecting bore is provided in right and left portions of the housing, respectively, each connecting bore being formed in a predetermined length in a direction extending from a radius of the through-hole having an open end at a position corresponding to the fitting groove in the spindle at the lowered position, and accommodating at least one ball.

4. A twist lock according to claim 1 or 2, wherein a fitting groove is formed in an inner circumferential surface of the housing, and at least one connecting bore is provided in right and left portions of the spindle, respectively, each connecting bore running in a radial direction of the through-hole and communicating with each other at a center of the spindle and having an open end at a position corresponding to the fitting groove in the housing, with the spindle being positioned at the lowered position and the upper lock being engaged with the fitting hole in the corner fitting of the container, and the connecting bores accommodating at least one ball.

5. A twist lock according to claim 3, wherein each connecting bore is inclined, by a predetermined downward gradient, from the open end facing the fitting groove formed in the spindle or the housing down to the direction in which the connecting bore extends.

6. A twist lock according to claim 1 or 2, wherein a fitting groove is formed in an outer circumferential surface of the spindle, and at least one connecting bore is provided in right and left portions of the housing, respectively, each connecting bore being formed in a predetermined length in a direction extending from a radius of the through-hole having an open end at a position corresponding to the fitting groove in the spindle at the lowered position, and accommodating a plurality of balls.

wherein the housing is provided with a pair of fitting bores vertically on a top surface of the housing at right and left sides of the upper fitting part along a concentric circle of the through-hole, a bottom end of each fitting bore communicating with the connecting bore, and wherein a guide is vertically slidable in each fitting bore and urged by a spring means to project slowly from the top surface of the housing, whereby an inner ball of the plurality of balls is allowed to fit in the fitting groove in the spindle, when the guide is positioned at the lowered position, and allowed to roll out of the fitting groove, when the guide is positioned at the raised position.

7. A twist lock according to claim 6, wherein each connecting bore is inclined, by a predetermined downward gradient, from the open end facing the fitting groove down to an other end of the connecting bore communicating with the fitting bore.

8. A twist lock according to claim 4, wherein each connecting bore is inclined, by a predetermined downward gradient, from the open end facing the fitting groove formed in the spindle or the housing down to the direction in which the connecting bore extends.

* * * * *